US010773420B2

(12) United States Patent
Moyal

(10) Patent No.: US 10,773,420 B2
(45) Date of Patent: Sep. 15, 2020

(54) DEVICE AND METHOD FOR CLEAVING A SUBSTRATE

(71) Applicant: LatticeGear, LLC, Beaverton, OR (US)

(72) Inventor: Gal Moyal, Los Gatos, CA (US)

(73) Assignee: LATTICEGEAR, LLC, Hillsboro, OR (US)

( * ) Notice: Subject to any disclaimer, the term of this patent is extended or adjusted under 35 U.S.C. 154(b) by 0 days.

(21) Appl. No.: 16/116,132

(22) Filed: Aug. 29, 2018

(65) Prior Publication Data

US 2019/0054658 A1 Feb. 21, 2019

Related U.S. Application Data

(63) Continuation-in-part of application No. 15/339,923, filed on Oct. 31, 2016, now Pat. No. 10,065,340, (Continued)

(51) Int. Cl.

| | |
|---|---|
| ***B28D 5/00*** | (2006.01) |
| ***B26F 3/00*** | (2006.01) |
| ***B26D 5/00*** | (2006.01) |

(52) U.S. Cl.

CPC ..... *B28D 5/0011* (2013.01); *B26D 5/007* (2013.01); *B26F 3/002* (2013.01); *B28D 5/0023* (2013.01); *B28D 5/0052* (2013.01)

(58) Field of Classification Search

CPC ..... B28D 5/00; B28D 5/0011; B28D 5/0023; B28D 5/0041; B26D 1/00; B26D 1/22; B26D 1/225; B26D 1/226; B26D 1/007

See application file for complete search history.

(56) References Cited

U.S. PATENT DOCUMENTS

| | | | |
|---|---|---|---|
| 3,998,201 | A | 12/1976 | Miura |
| 4,790,465 | A | 12/1988 | Fellows |

(Continued)

FOREIGN PATENT DOCUMENTS

| | | |
|---|---|---|
| EP | 0334751 | 9/1989 |
| WO | 93/04497 | 3/1993 |

OTHER PUBLICATIONS

Figueroa, Victor "Designing a Mechanism to Cleave Silicon Wafers," MIT Sep. 2004.

*Primary Examiner* — Jason Daniel Prone
*Assistant Examiner* — Richard D Crosby, Jr.
(74) *Attorney, Agent, or Firm* — Paul B. Heynssens Attorney at Law PLC

(57) ABSTRACT

A device and method for cleaving a sample includes: creating an indentation on a top surface of the sample by applying a downward force along a vertical axis, the axis perpendicular to the top surface of the sample; providing a breaking pin located under the sample to touch the bottom surface of the sample at a position that is directly opposite from the indentation; and, a cleaving bar for applying a downward force on the sample by providing a left side and right side breaker pin wherein the downward force comprises a left-side downward force extended through the left-side breaker pin and right-side downward force through the right side breaker pin. Further, the pins that provide the left-side and right-side downward force are disposed on a breaker bar and arranged to be on opposite sides of a vertical axis that extends through the indentation on the top surface.

19 Claims, 27 Drawing Sheets

First Example of a Device for Cleaving a Substrate
10

13-13
of FIG. 14

Second Example of a Device for Cleaving a Substrate

Related U.S. Application Data which is a continuation-in-part of application No. 15/191,293, filed on Jun. 23, 2016, now Pat. No. 10,068,782, and a continuation-in-part of application No. 13/664,125, filed on Oct. 30, 2012, now abandoned.

(60) Provisional application No. 62/183,674, filed on Jun. 23, 2015, provisional application No. 61/558,122, filed on Nov. 10, 2011.

(56) References Cited

U.S. PATENT DOCUMENTS 4,995,539 A * 2/1991 Richard ..... B26F 3/002 225/103
5,016,800 A 5/1991 Sato
5,069,195 A 12/1991 Barozzi
5,740,953 A * 4/1998 Smith ..... B28D 5/0005 225/1
6,223,961 B1 * 5/2001 Boguslavsky ..... B28D 5/0023 225/103
6,577,804 B2 6/2003 Murakami
6,578,748 B2 * 6/2003 Matsuoka ..... B23D 31/003 225/100
6,598,508 B1 * 7/2003 Ishikawa ..... B26D 5/08 83/613
6,978,071 B2 * 12/2005 Hwang ..... G02B 6/245 225/21
7,013,776 B2 * 3/2006 Ishikawa ..... B26D 5/08 476/31
7,070,078 B2 * 7/2006 Song ..... B26D 1/18 225/105
8,478,100 B2 * 7/2013 Toda ..... G02B 6/3806 385/135
8,967,025 B2 * 3/2015 Ishihara ..... G02B 6/25 83/156
9,016,535 B2 * 4/2015 Hasegawa ..... G02B 6/25 225/96
9,272,941 B2 3/2016 Giron
9,295,969 B2 * 3/2016 Okuma ..... B23K 26/0853
9,302,410 B2 * 4/2016 Shimoi ..... B28D 5/00
9,541,473 B2 * 1/2017 Walter ..... G01N 1/06
9,726,823 B2 * 8/2017 Zhao ..... G02B 6/25
9,908,255 B2 * 3/2018 Takaichi ..... H02K 15/03
9,957,187 B2 * 5/2018 Yamamoto ..... C03B 33/033
10,065,340 B2 * 9/2018 Moyal ..... B28D 1/225
10,068,782 B2 * 9/2018 Teshima ..... H01L 21/67092
2007/0158381 A1 * 7/2007 Lisec ..... C03B 33/033 225/2
2008/0006669 A1 * 1/2008 Stangl ..... C03B 33/06 225/2
2008/0246066 A1 * 10/2008 Lake ..... H01L 27/14618 257/294
2009/0230102 A1 9/2009 Soyama
2010/0011927 A1 * 1/2010 Lee ..... B26D 3/08 83/100
2010/0012632 A1 * 1/2010 Sakamoto ..... B23K 26/12 219/121.72
2010/0163593 A1 * 7/2010 Song ..... G02B 6/25 225/96
2010/0244608 A1 * 9/2010 Nakamura ..... H01F 1/08 310/156.38
2011/0252935 A1 * 10/2011 Welsh ..... G01N 1/08 83/37
2012/0036696 A1 * 2/2012 Murakami ..... H01F 7/0221 29/426.2
2013/0119106 A1 * 5/2013 Moyal ..... B28D 1/225 225/2
2014/0299645 A1 10/2014 Lurie
2016/0136835 A1 * 5/2016 Ohshima ..... H01F 41/0286 225/104
2017/0087744 A1 3/2017 Moyal
2019/0054658 A1 * 2/2019 Moyal ..... B28D 5/0011

* cited by examiner

First Example of a Device for
Cleaving a Substrate
10

First Example of a Device for
Cleaving a Substrate
10

First Example of a Device for
Cleaving a Substrate
10

First Example of a Device for
Cleaving a Substrate
10

First Example of a Device for
Cleaving a Substrate
With Compound Dial Indenter
10

First Example of a Device for
Cleaving a Substrate
With Compound Dial Indenter
10

Second Example of a Device for
Cleaving a Substrate

Second Example of a Device for
Cleaving a Substrate

Second Example of a Device for Cleaving a Substrate

Second Example of a Device for
Cleaving a Substrate 8-8
of FIG. 10

Second Example of a Device for
Cleaving a Substrate

Second Example of a Device for
Cleaving a Substrate 9-9
of FIG. 12

Second Example of a Device for
Cleaving a Substrate

Second Example of a Device for
Cleaving a Substrate 13-13
of FIG. 14

Second Example of a Device for
Cleaving a Substrate

Second Example of a Device for
Cleaving a Substrate 12-12
of FIG. 16

Second Example of a Device for
Cleaving a Substrate

Second Example of a Device for
Cleaving a Substrate

VIEW C
of FIG. 18

Second Example of a Device for
Cleaving a Substrate

Third Example of a Device for
Cleaving a Substrate
200

1. FRONT VIEW

2. TOP VIEW

3. SIDE VIEW WITH ANGLE RANGE

1. Front Vew Before

2. Front View-After

DEVICE AND METHOD FOR CLEAVING A SUBSTRATE

CROSS-REFERENCE TO RELATED APPLICATIONS

This is a continuation-in-part of application of U.S. patent application Ser. No. 15/339,923 filed Oct. 31, 2016, which is a continuation-in-part of application of U.S. patent application Ser. No. 13/664,125 filed on Oct. 30, 2012, which claims the benefit of U.S. Provisional Patent Application Ser. No. 61/558,122 filed on Nov. 10, 2011, the contents of which are hereby incorporated by reference. This application is also a continuation-in-part of application of U.S. patent application Ser. No. 15/191,293 filed Oct. 31, 2016 which claims the benefit of U.S. Provisional Patent Application Ser. No. 62/183,674 filed Jun. 23, 2015, the contents of which are hereby also incorporated by reference.

TECHNICAL FIELD

This description relates generally to a methods and devices for cleaving substrates typically used in the semiconductor industry and more specifically to cleaving crystalline, mono-crystalline, and amphorous materials such as a silicon or gallium arsenide, or sapphire, glass or the like.

BACKGROUND

Cleaving substrates produced by the semiconductor industry is a common operation to separate circuits processed on a common substrate into individual units for subsequent packaging typically in a highly automated and precise operation. During fabrication the circuits may often be sampled and tested as part of the quality control effort or the like. Since testing is not a high volume operation it is not as highly automated as production operations, and typically utilizes less automated methods to cleave the substrates or wafers into samples for testing.

As circuit features are decreased in size it has become more difficult to accurately cleave the substrates for testing by hand, or other laboratory suitable methods. Currently, an alternative to hand cleaving is to use expensive and highly accurate machinery that is available, that tends to be more than is needed in the testing lab.

Currently, there are two typical approaches to cleaving mono-crystalline substrate materials and the like. The first approach is a low-cost, low-sophistication option, which requires a highly skill-dependent procedure (based on experience and expertise and training). It involves manually aligning by human sight a substrate, and using hand tools, such as scriber pens or rudimentary cleaving apparatus. In particular the procedure involves manually scribing a line on the back side of a substrate using a scribing knife, placing the wafer over a cleaving bar from the glass industry, and manually pushing down on the work piece using two pins.

The second approach, which is more high cost but less error prone, utilizes a mechanized approach that is capital intensive in both equipment cost and operator training and, as a result, is used by approximately the top 25 semiconductor manufacturers (worldwide). Such an approach may utilize microscopic alignment to a target feature and an induced shock wave to cause cleaving. This later type of cleaving apparatus is not only complicated to make and use, but requires a much larger footprint and takes valuable space in the lab and has an ongoing high cost of operation.

These approaches have shortcomings that may include on the low tech side: a reliance on a pre-scribed cleave line in the silicon, significant human skill and or training to operate, high variability due to the human factor. On the high precision end of the available equipment spectrum the equipment available may be very large and require high capital initial expenditure, with high operating costs, complexity, and is overly precise for many operations.

Accordingly, it would be desirable to provide a machine to cleave substrates that is highly accurate, low cost and suitable for use in a testing lab or similar environment.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The device includes a stationary stage upon which a sample is initially and approximately positioned for cleaving with the aid of a fixable guide coupled to a stage. A block structure including an indenter with a scribe is movable along an edge of the fixed stage. The block also includes a vertically movable cleaving bar. The indenter is slidably (vertically) disposed in the block and under spring bias to keep it in an upward position. The block is coupled to a top portion of a Newport stage, and the bottom portion of the Newport stage is attached to the housing body or platform. The top portion of the Newport stage and the bottom portion of the Newport stage are slidably coupled in a linear direction via a conventional ball bearing mechanism. Movement of the top portion relative to the bottom portion is controlled via a knob controlled conventional micrometer mechanism. The block includes a bottom breaker pin disposed in line with the indenter scribe. The cleaving bar includes two breaking pins positioned on either side to the bottom breaking pin disposed in the block.

The device may further include a vacuum pump and switch coupled to vacuum holes in the stage to hold a sample in place. The device may further include a microscope positioned to view the indenter and sample under magnification. A camera may also be included to view the indenter and sample area, and is typically coupled to a computer equipped with software to project a virtual guide line on the image displayed to aid in positioning the indenter. In a further alternative example a laser device may be positioned and coupled to the device so that a laser line is projected on the sample that is indicative of the indenter position over the sample.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a semiconductor wafer (or equivalently "substrate") cleaving system. Although the present examples are described and illustrated herein as being implemented in a general wafer cleaving system, the system described is provided as an example and not a limitation. As those skilled in the art will appreciate, the present examples are suitable for application in a variety of different types of flat planar wafer cleaving systems utilized in cleaving crystalline and amphorous substrates.

The cleaving device provides a low cost, high quality, high accuracy cleaving of mono-crystalline material and other brittle substrates. Further, the device and method of the present invention offers successful cleaving through a target even with operators having minimal experience and expertise are using it, as it does not rely on human capabilities, such as hand and eye coordination, skill, or extensive training.

Further, the present invention is well-adapted for use for site specific, cross-sectional examination, with accuracy of a few (typically +/−10 microns) microns to the area of interest. The present invention works well with various samples including front-end, back-end, TSVs, and single die, for example. Another well-suited use includes a bulk removal step prior to FIB "focused ion beam". The present invention has accuracy on the order of +/−10 microns. The present invention can be used to reduce large substrate pieces to small samples suitable for further preparation in ion beam and direct viewing in electron beam instruments. Yet another use for the present invention includes quality analysis of wafers where a quality analysis of wafer sample cross-section is desired, for example. Another use for the present invention includes sample preparation for failure analysis, process monitoring, and product development.

Figure 4:
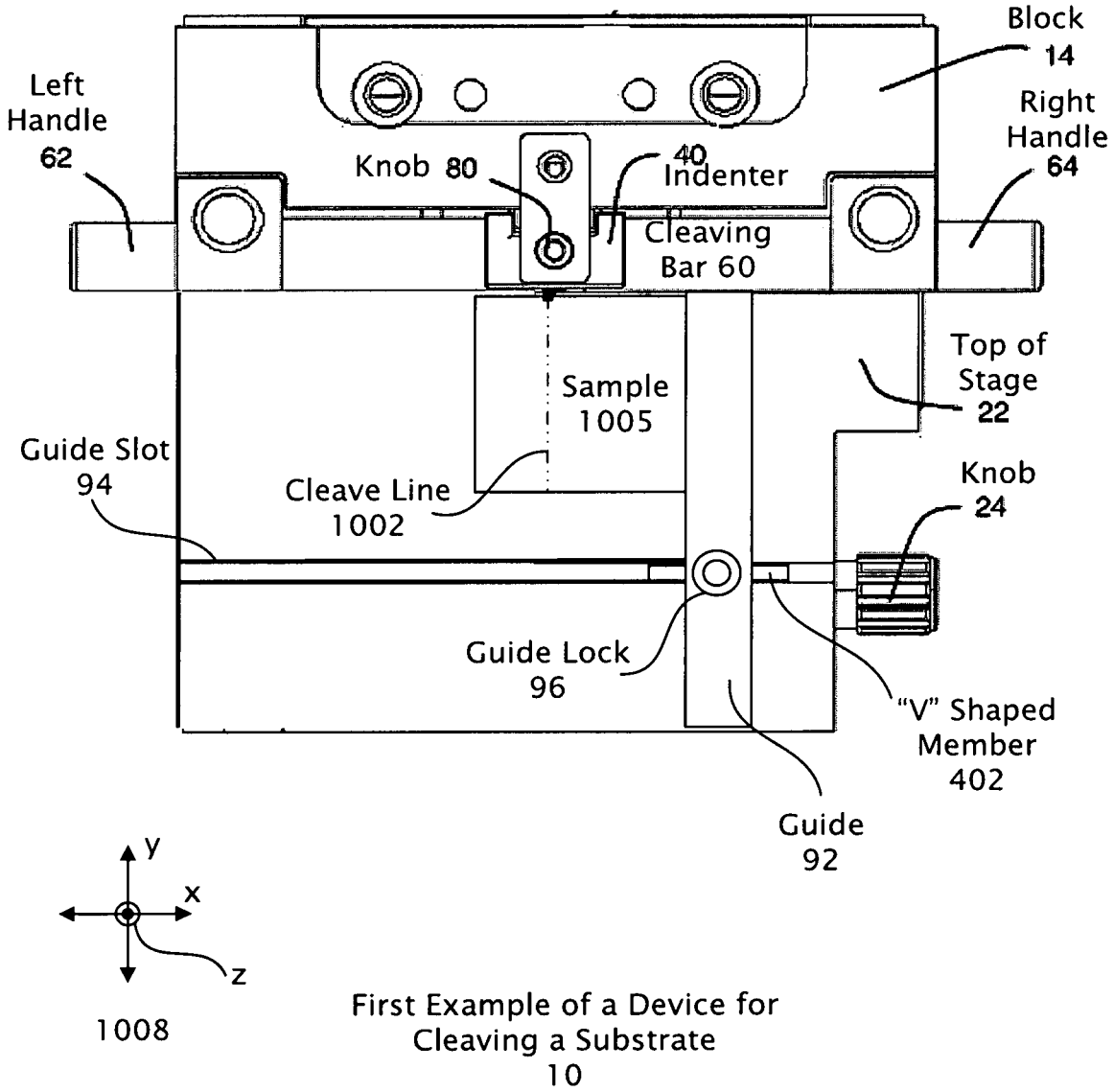
FIG. 4 is a top view of a first example of a device for cleaving a substrate.

The description of directions regarding various movements may be referenced to the Cartesian coordinates 1008 shown in FIG. 4. In general, the x axis is motion from right to left on the stage, the y-axis is top to bottom positioning on the stage, and motion along the z axis is motion above or below the stage (vertical motion or position).

FIGS. 1-6 show a first example of a device for cleaving substrates 10.

The device 10 includes a stationary stage 20 with a guide 92 for initially positioning a desired cleave line 1002 of a sample 1005 relative to an indenter mechanism 40 that includes a diamond tip scribe 48 used to indent the sample 1005 on the cleave line 1002 target. In sample preparation it is often desired to accurately place a cleave line 1002 since inaccurate positioning can ruin the devices on the sample or otherwise spoil the sample. The device 10 facilitates accurate cleaving of the sample by providing initial rough sample positioning on the fixed stage 20 followed by fine adjustment of the diamond tip scribe 48 position by moving the scribe.

The sample to be cleaved typically has at least one straight edge, and typically has at least one substantially right angle in its shape so that visual alignment is facilitated. For odd shaped samples the procedure outlined below may be modified as needed, including being aided by use of jigs and fixturing as known to those skilled in the art, to provide an edge for use against the guide 92 or otherwise aid in aligning a sample. An example would be a fixture (not shown) with a square outline and a round aperture for use in scribing a round silicon wafer positioned in the fixture.

To use the device 10 the cleaving bar 60 is typically initially in the lowered position. The sample cleave line position is first aligned with the diamond tip scribe 48 roughly by eye. Once the desired cleave line 1002 on a sample 1005 is approximately lined up with the scribe tip 48, and the guide 92 is set 96 against the side of the sample. Next the diamond tip scribe 48 is moved in position with its position finely adjusted over the desired cleave line in a second iteration of alignment. The sample 1005 remains in a fixed position on the stage 20 with the vertical edge (y direction) of the sample resting against the guide 96. As the fine adjustment is made, the diamond tipped scribe 48 may be moved from side to side (in the x direction) by turning a knob 24 adjustment actuating a conventional Newport Stage 16 upon which a block 14, including a cleaving bar 60 and the indenter mechanism 40 with diamond tipped scribe 48 are attached. As the knob 24 is turned the diamond tipped scribe 48 moves (in the x direction) and can be precisely positioned over a desired indentation position for initiating a cleave (i.e., cleave line 1002) on the stationary substrate 1005. It is worth pointing out that the diamond tipped scribe 48 protrudes slightly outward from the face of the cleaving bar 60, so that when the diamond tipped scribe is lowered the substrate resting against the cleaving bar 60 may be indented.

Figure 20:
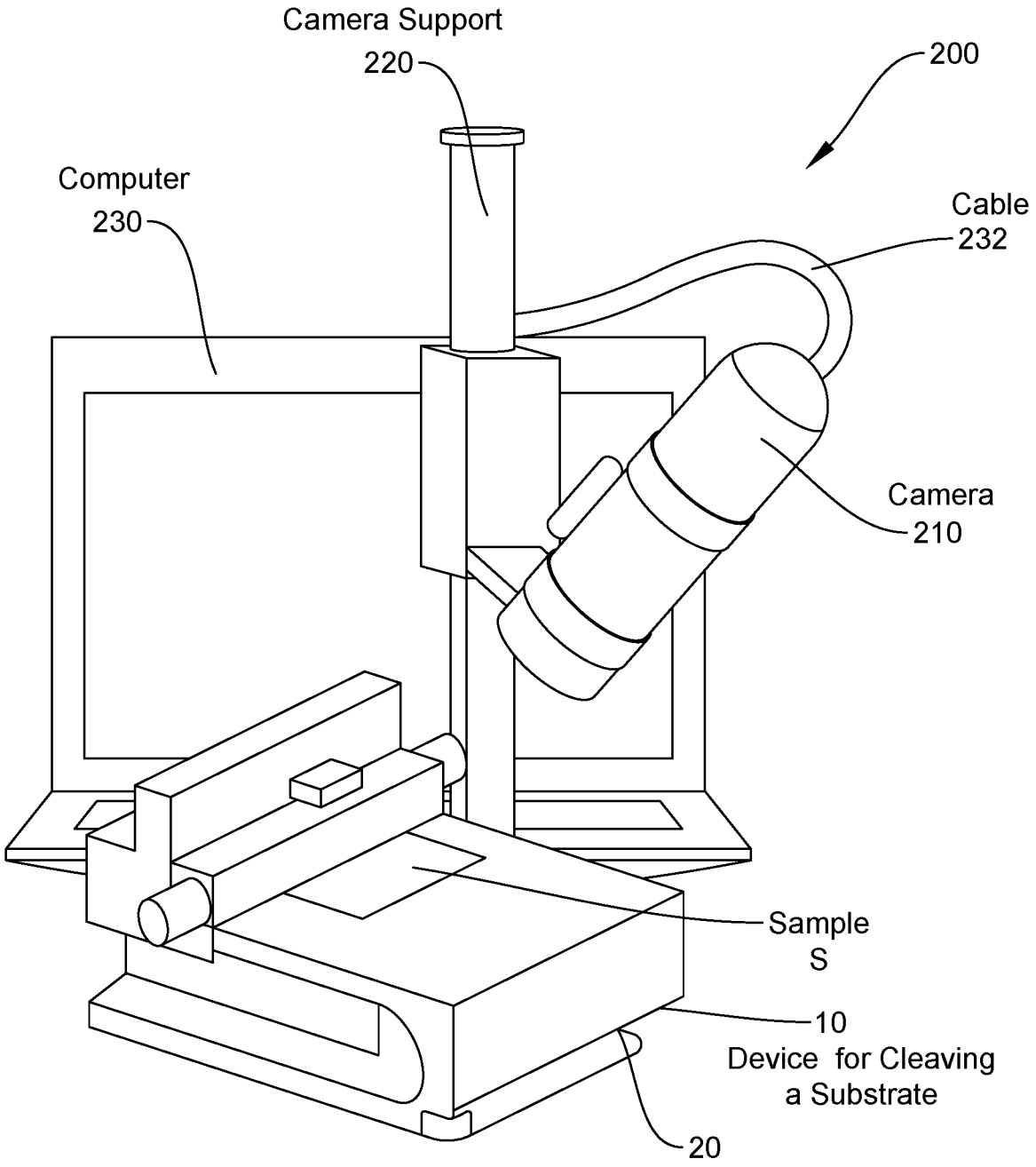
FIG. 20 is a front view of a third example illustrating a camera system example of a device for cleaving a substrate.

Alignment of the diamond tipped scribe 48 over the cleave line 1002 position may be achieved by eye, by aid of magnification (typically with a microscope, or alternatively with a camera microscope combination shown in FIG. 20). Also, to aid alignment a conventionally constructed laser device (not shown) may be used to project a line along a desired cleave line to aid the positioning of the scribe. In an alternative example of a positioning aid, a camera may be used in conjunction with a computing device (as shown in FIG. 20) such as a laptop to run software that produces a cleave line on a screen image of the sample extending from the sample to the diamond tip scribe. Once the tip 48 is in position the projected line overlays the cleave line and the diamond tip. The diamond scribe tip 48 may then be brought down to indent the sample.

Once the diamond tip scribe 48 is finally aligned (as viewed either by eye or by use of the above described aids) using the micrometer 2602, over the desired cleave indent location (typically along the edge of the sample 1005 abutting the cleaving bar 60, where the cleave line 1002 is to begin) the indenter mechanism is lowered (z direction) in a controlled manner to indent the surface of the sample 1005, typically to a controlled depth. This indent will serve to initiate, in a subsequent step, a cleave along cleave line 1002 in the sample that has been accurately placed thanks to the aid of the device 10. The diamond tip 48 is attached to an indenter mechanism 40 that may include a compound screw and dial mechanism (2006 of FIGS. 5-6) to control the indent depth in a repeatable manner. A first dial (2607 of FIGS. 5-6) is used to lower the diamond tipped scribe 48 to just touching the surface of the sample. Next a second concentric outer dial (2608 of FIGS. 5-6) is turned a desired number of degrees to provide an indent of a controlled and repeatable depth.

During the preceding, a horizontal edge (x direction) of the sample 1005 has been resting against the front face of a lowered cleaving bar 60. To cleave the sample, the cleaving bar 60 is raised, exposing three breaking pins (lower pin 50 and upper pins 2501 of FIG. 25) that will be used to cause the sample to cleave along a cleave line 1002 initiated at the indent made in the substrate. The breaking pins are disposed in the block 14 and its components (namely cleaving bar 60). The lower breaking pin 50 is positioned in the block 14 facing up, so that its apex is in alignment with the diamond tipped scribe 48 (y direction) and is positioned behind or rearwards of the scribe tip (in the y direction). Disposed in the cleaving bar 60 are an upper pair of breaking pins (2501 of FIG. 25) positioned typically equidistant from the diamond tipped scribe 48.

To cleave the sample a three point cleaving is utilized to create a clean cleave. The cleaving bar is raised and the sample's alignment against the vertical guide bar 92 is maintained as the sample is pushed back over the exposed lower breaking pin 50, now that the cleaving bar 60 has been raised. This movement utilizing the guide 92 keeps the indent on the sample (2505 of FIG. 25) in line with the apex of the bottom breaking pin 50. The cleaving bar 60 is lowered and the two breaking pins (2501 of FIG. 25) disposed in the cleaving bar 60 contact the substrate 1005 (note the indenter tip 48 need not be retracted as the thickness of the upper breaker pins causes the pins to contact the substrate surface well before the diamond tip 48 would when lowering the cleaving bar 60). As the cleaving bar 60 is pushed down (either manually, or equivalently by the screw 80) to provide an applied force (2503 of FIG. 25) the sample is cleaved precisely along the desired cleave line 1002 due to its accurate positioning, and the maintaining of that position during the cleaving process that is aided by the device 10.

The forces applied in the cleaving process are as follows: as the breaker bar 60 is pushed downward by means of the left and right handles 62, 62, which causes the pins 2501 to apply a downward force on the top surface of the sample. This force is resisted by the pin 50, which contacts the bottom surface of the sample. This bottom pin 50 aligns along the same vertical axis as the indentation on the top of the sample,—thus, the indenter, the indentation and the pin 50 all lie in the same line albeit at different heights on that common vertical axis—and the indenter is operable up and down whereas the pin 50 is stationary. Because the top surface of the sample has an indentation, the downward force transmitted through breaker pins 2501, and resisted by pin 50, is concentrated at the indentation and the sample is cleanly cleaved at the indentation. Now that the operation of the device 10 has been described in relation to its various components the components themselves will now be described in more detail.

Base 12 of the device for cleaving substrates is a platform upon which the device may be assembled. The base 12 is a non-moving part, typically made from aluminum or an equivalent material.

The stage 20 is fixed to the base 12, and does not move during operation of the device 10 for cleaving substrates (or "samples"). The stage 20 provides a flat surface 22 upon which a substrate may be supported while being indented and cleaved. The stage 20 has a substantially flat top 22, and is typically made from aluminum or its equivalent. The top of the stage 22 includes a horizontal (x direction) guide slot 94 that is narrower at the table top than at the bottom of the slot (i.e., an inverted "V" shaped slot). A vertical guide 92 and guide lock 96 are coupled to the stage 20 via the guide slot 94.

The vertical guide 92 is a typically rectangular elongate member that may be moved across the stage (in the x direction) and may be locked in place via guide lock 96. To maintain vertical orientation of the guide, a generally "V" shaped member 402 (conventionally constructed) is part of the guide, disposed in the guide slot 94 and thus slidably coupled to the generally "V" shaped guide slot 94. Coupled to and at right angles to the "V" shaped member 402 is the guide 92. Accordingly the guide 92 is thus slidably coupled to move across the stage 20 in the x direction, and provides a vertical (y axis 1008) surface against which the vertical edge of a sample 1005 may rest.

A conventionally constructed guide lock 96 allows the scribe guide to be fixed in place (typically by a knob and screw arrangement, disposed in a threaded aperture in the guide 92, so that the end of the screw contacts the base of the grove 94) so that the guide 92 does not move when the screw is extended. In equivalent examples alternative constructions of the guide lock known to those skilled in the art may be employed.

A plurality of suction holes 86 may be disposed in the top 22 of the stage 20 to aid in keeping the sample 1005 in place. The holes may be coupled to a vacuum system (not shown) whereby activation of a vacuum "on" switch (not shown) draws suction through the holes 86 to more securely hold the sample temporarily to the stage. Deactivating the switch releases the sample. Although not depicted in the appended drawings, the device 10, accordingly, includes a vacuum pump, power source, controller, and related components as would be readily understood in the art to provide and control the vacuum source.

The stage 20 also provides a recess underneath the stage top 22 to provide clearance for a movable Newport stage 16 partially diposed underneath the stage 20, including the Newport stage adjustment mechanism 2601, 2602 that operates freely in the recess. The recess advantageously allows the adjustment knob 24 controlling movement of the diamond tip scribe 48 to be placed at a lower right hand corner of the device 10 so that the operator may conveniently turn the knob at a distance from the moving block 14 and diamond tip scribe 48.

As previously mentioned the indenter mechanism 40, including the diamond tip 48 is also movable in the x direction 1008 by turning the knob 24 coupled to the micrometer adjustment mechanism 2602. The stage 20 is typically square or rectangular and one edge is in parallel alignment and abutting (with a small gap) a straight edge of the block 14, so that when the block 14 (via the Newport stage movement) is moved in the x direction 1008, the indenter 40 and cleaving bar 60 also move in the x direction in close proximity to the fixed stage 20 (and sample).

The Newport stage 16 includes Newport stage top portion that moves linearly from side to side in the x direction, is slidably coupled to a Newport stage bottom portion fixedly coupled to the base 12. The Newport stage 16 with a micrometer adjustment 2602 is conventionally constructed and causes a top portion of the Newport stage 16 to move back and forth in the x direction 1008 with micrometer precision.

The Newport stage 16 is conventionally constructed and includes a bottom portion slidably coupled to a top portion in a linear direction (here oriented in the x direction). In this device 10 the Newport stage 16 is oriented so that it slides in the x direction 1008. To move the top portion of the Newport stage in relation to the bottom portion a conventional micrometer screw mechanism 2602 is utilized. A knob 24 is coupled to a micrometer screw mechanism 2602 having a first end fixedly coupled to the Newport stage bottom portion and a second end coupled to the top portion of the Newport stage. The first end and second ends being coupled via a spindle 2601 with the intervening micrometer screw mechanism 2602, such that turning the knob 24 causes the Newport stage top piece 2603, and anything attached to it such as the diamond tip 48 to move in the horizontal x direction 2605 from side to side.

Since adjusting position with a micrometer takes many turns to move the diamond tip scribe 48 a small amount, the device 10 advantageously allows for rough positioning of the sample 1005 on the fixed stage 20 and final fine positioning of the scribe 48 to create an accurately positioned indent for cleave line 1002 on the sample 1005. The micrometer adjustment tends to minimize the amount of time spent spinning the micrometer knob 24.

A block assembly 14 is fixedly coupled to the movable (x direction) top portion of the Newport stage 16. Block 14 supports an indenter mechanism 40 that is vertically slidable (in the Z or vertical direction) in a track 42 of FIG. 3 in the block 14, also a cleaving bar 60 is vertically slidable (in the Z or vertical direction) and coupled to the block 14 via guide rods 98.

The indenter mechanism 40 is slidably coupled in the vertical direction to the block 14, and may include conventional spring bias (not shown) to keep the surface of the indenter handle 44 pushed upwards (Z direction) against an end of a threaded rod 82 opposite to the knob end 80 of the threaded rod 82. Such a retraction spring, is adapted to hold the slide member at a top position in the track. The threaded rod 82 is disposed in a threaded hole in a protrusion from the block 14, or as shown in the FIGs, a rectangular tab member fixedly attached to the block and protruding from it.

Indenter mechanism 40 includes a handle 44 and the indenter 40 that further includes a tip holder 46 supporting and housing a diamond tip scribe tip 48. The tip holder 46 for holding the scribe tip 48 is conventionally constructed. The diamond scribe tip 48 is positioned so that it slightly protrudes past the face of the cleaving bar 60. This is so that in operation when the indenter mechanism 40 is depressed (z direction) the diamond tip scribe 48 contacts the sample 1005 that has been pushed up against the face of the cleaving bar 60. Vertical motion (z direction) of the indenter mechanism through the cleaving bar 60 is facilitated by a let out channel disposed in the cleaving bar 60 so that clearance for the indenter mechanism 40 operating in the z direction is provided.

The indenter mechanism 40 is generally "T" shaped with the top of the "T" functioning as a handle 44, and as a support structure to which a diamond tip 48 is coupled to the leg of the "T". The diamond tip is shown in a vertical orientation. However, in equivalent examples the tip may be provided with a conventionally constructed adjustment mechanism so that it may be tilted at an angle deviating from the vertical. Such a mechanism may provide detents of specific angles or constructed to provide continuous variation in the deviating angle.

Figure 24:
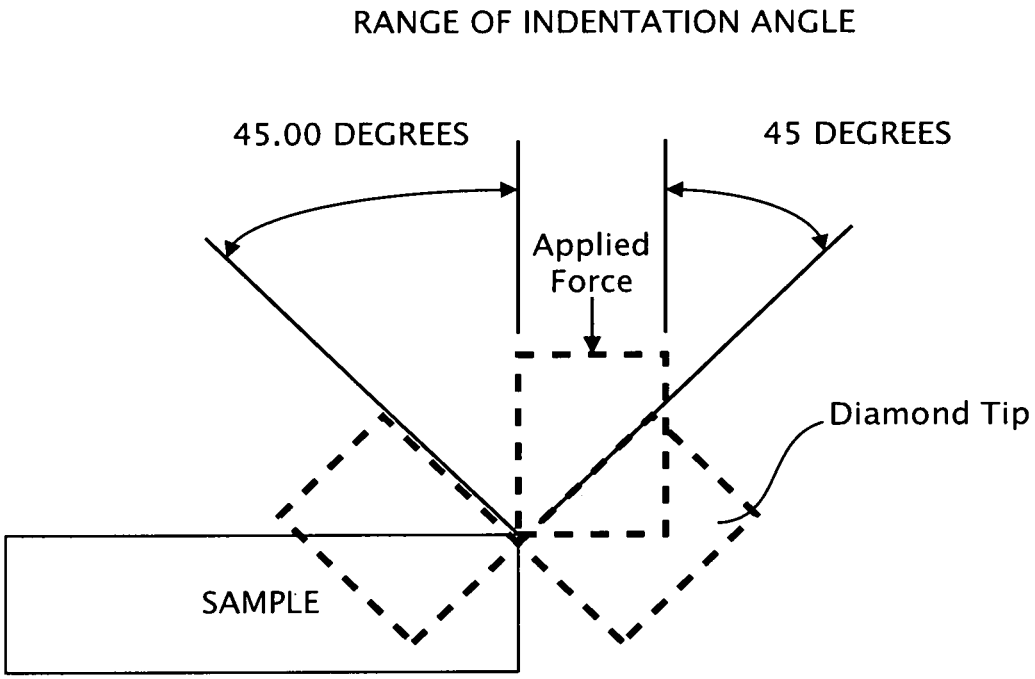
FIG. 24 illustrates an alternative step of the method of FIG. 22.

Although a 90-degree dent is described here the "scribe" could be made at various angles between 45-135 (+/−45) degrees (see FIG. 24). A derivative of the current example may be implemented with this angle adjustment to improve positioning accuracy and minimize the contact area between the sample and the diamond tip.

The leg of the "T" is operable through the handle 44 to move the lever vertically downward, the lever further carrying the diamond tip scribe 48 in a tip holder 46, the indenter 40 thus has a diamond tip 48 at a lower, leading edge. In alternative examples the diamond tip scribe may be replaced by equivalent scribing materials.

A precision knob 80 positions above the indenter 40. The precision knob includes a threaded rod to enable precision adjustment of the indenter 40 relative to the stage 20, or more particularly a sample on the stage. With the breaker or cleaving bar down, the operator turns the indenter drive precision knob 80 clockwise to push the indenter to touch the top of the sample, then by turning the knob 80 as needed the operator can feel pressure of the indenter and scribe as an indentation is made on the sample. This enables a more accurate and repeatable cleaving operation as the knob can be controlled in a precise manner whereby a vertical distance traveled can be translated into "turns of the knob" in an instruction manual for the operation. In alternative examples, knob 80 may be replaced by one or more dials constructed to bring the scribe down to the sample surface, and then to next provide a measured indent depth.

Cleaving bar 60 is made from aluminum or equivalent, and is slidably coupled (y direction) to right and left guide rods 98 anchored in the block 14. For fine adjustments the cleaving bar 60 includes a scale 90 graduated in any desired units. The cleaving bar 60 includes a right handle 62, and a left handle 62. On a bottom surface of the cleaving bar 60 are disposed a pair of breaking pins (2501 of FIG. 25) disposed equidistant from the point of the diamond tip 48.

The pair of guide rods 98 vertically protrude through the right and left sides of the cleaving bar 60. The guide rods may include bushings to better align the breaker 60 along a vertical axis. The guide rods are used in place of the sliders, described in the second example, below. The guide rods of this example provide a more stable alignment of the cleaving bar 60 and have less degrees of freedom compared to the sliders of the second example.

Figure 15:
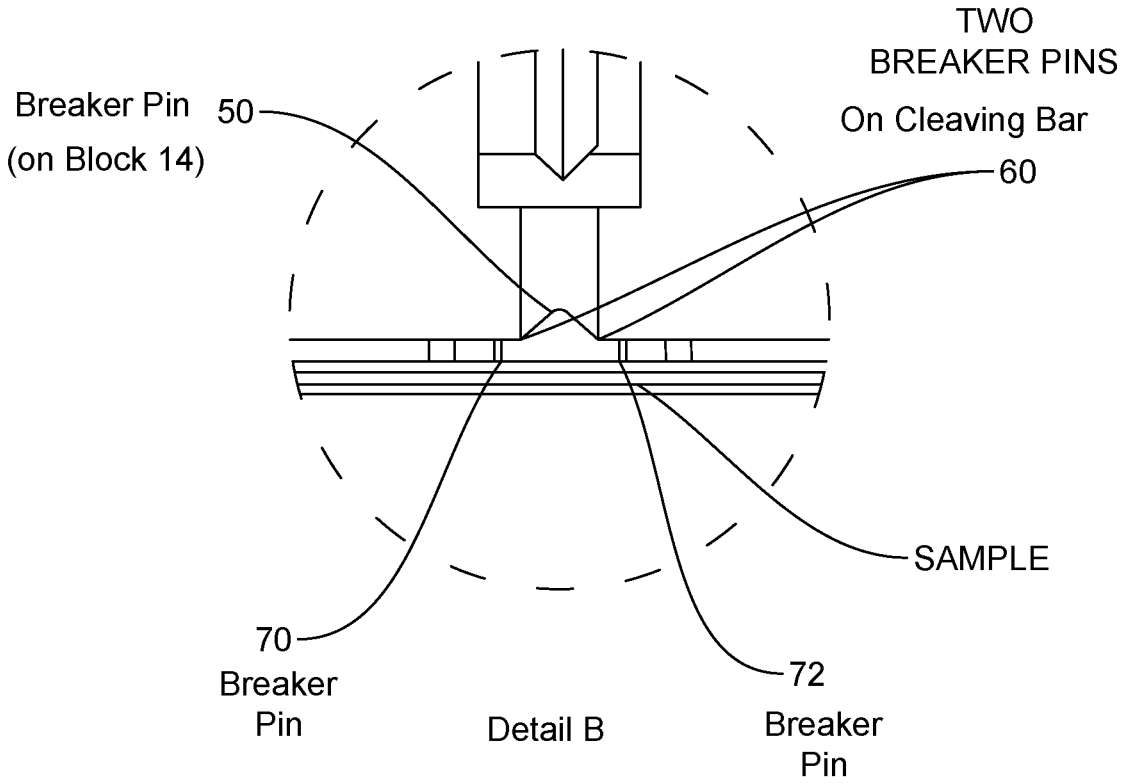
FIG. 15 is a detail view along the line 13-13 of FIG. 14.
Figure 16:
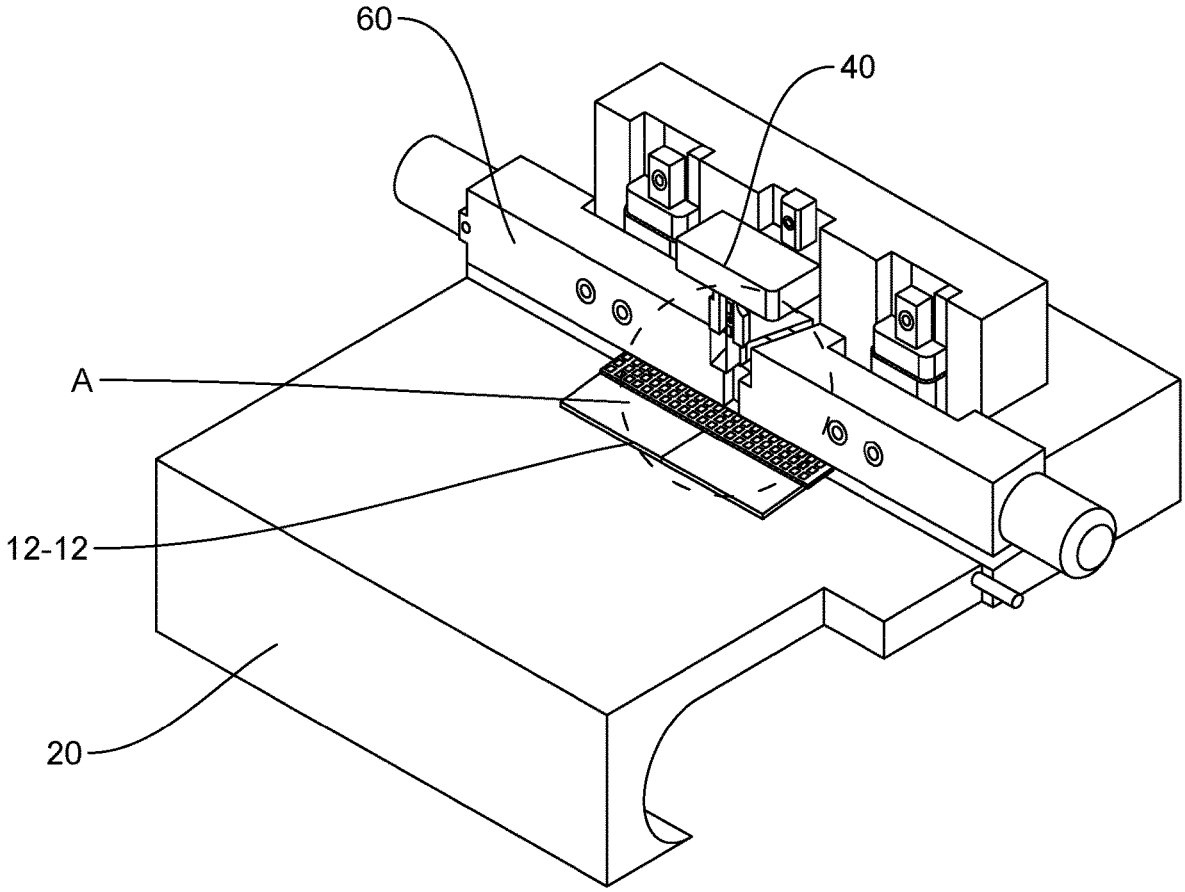
FIG. 16 is a partial offset frontal view of the second example of a device for cleaving a substrate.
Figure 17:
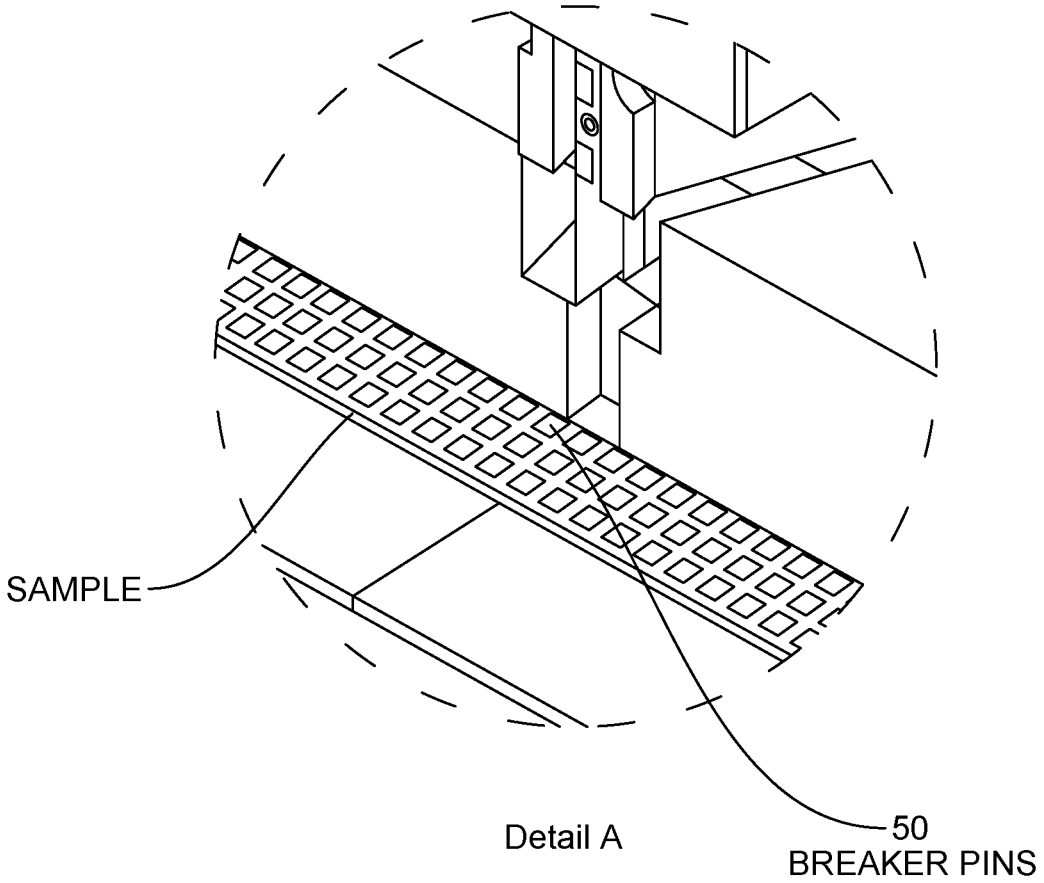
FIG. 17 is a detail view along the line 12-12 of the example of FIG. 16.
Figure 18:
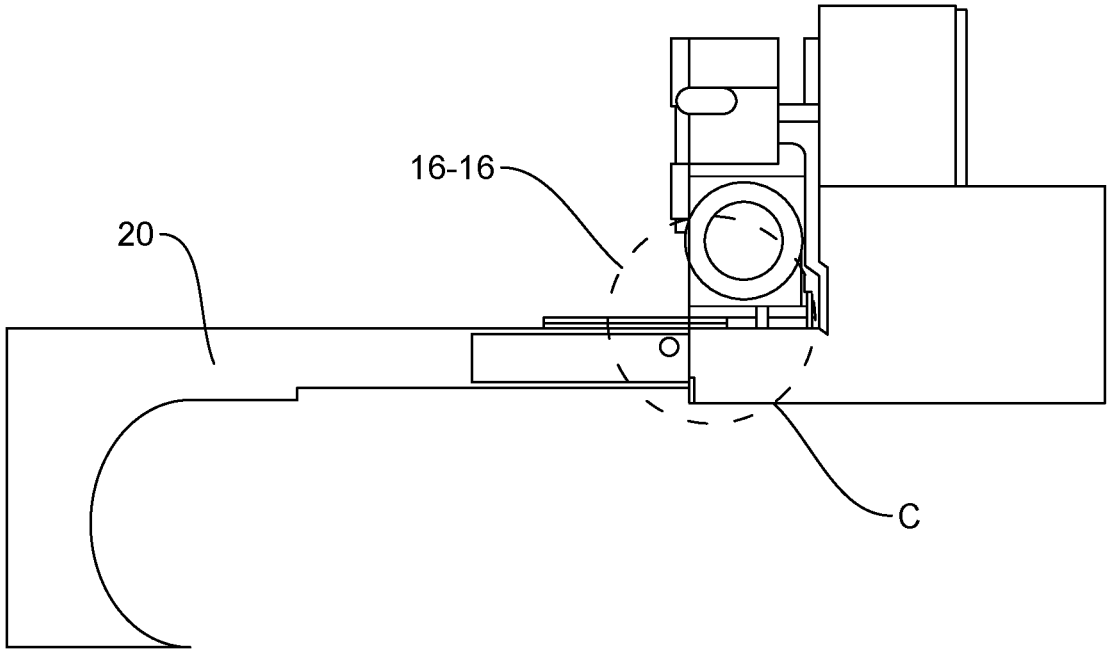
FIG. 18 is a partial side view of the example of FIG. 16.
Figure 25:
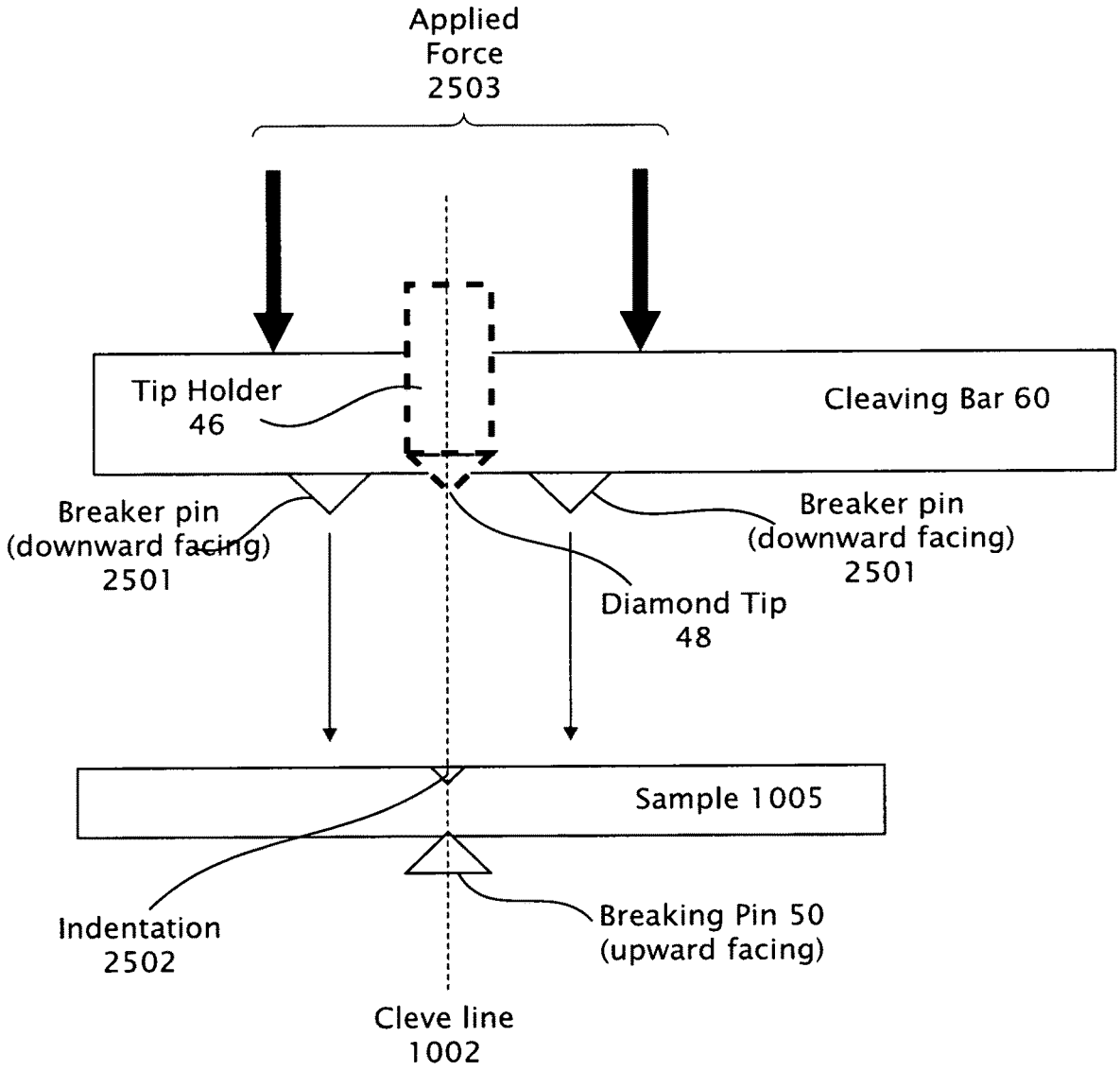
FIG. 25 illustrates a sample being cleaved by the method of FIGS. 22-24 at first point in time.

The cleaving bar 60 is typically one long piece extending the entire width of the stage. The bar 60 thus extends from a left side, which includes a left handle 62 to the right side having a corresponding right handle 64. This bar 60 moves up and down on a vertical axis and the left handle 62 and right handle 62 cooperate to enable an operator to move the bar 60 up and down to break the sample after cleaving. The cleaving bar includes a left side breaker pin and a right side breaker pin, both located on a bottom surface of the bar and disposed on either side of a vertical axis defined between the indenter and pin 50. This way when the bar 60 is in the down position, the left pin 70 and right pin 72 pushes evenly against the sample. The pins (70 and 72 of FIG. 15, and also 2501 of FIG. 25) move vertically with the breaker bar 60 as seen in FIG. 25, for example.

Figure 1:
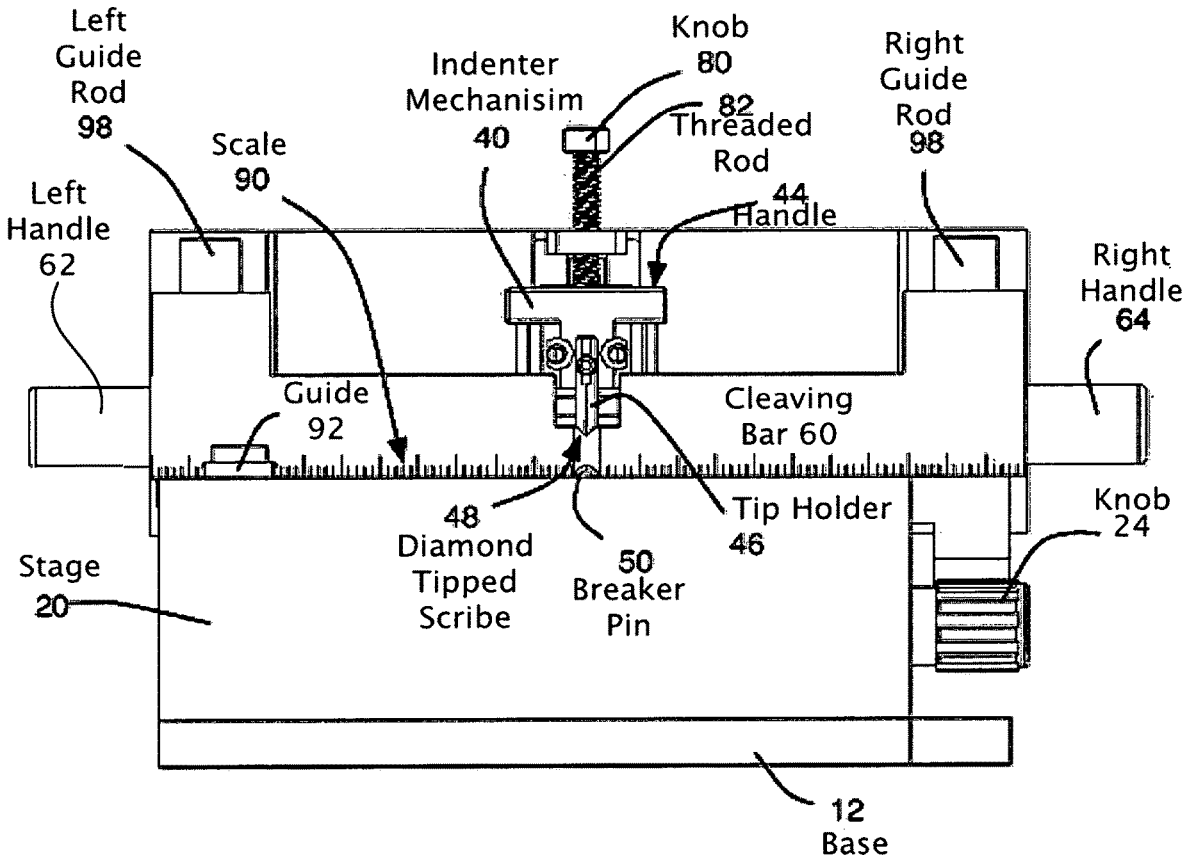
FIG. 1 is a front view of a first example of a device for cleaving a substrate.
Figure 2:
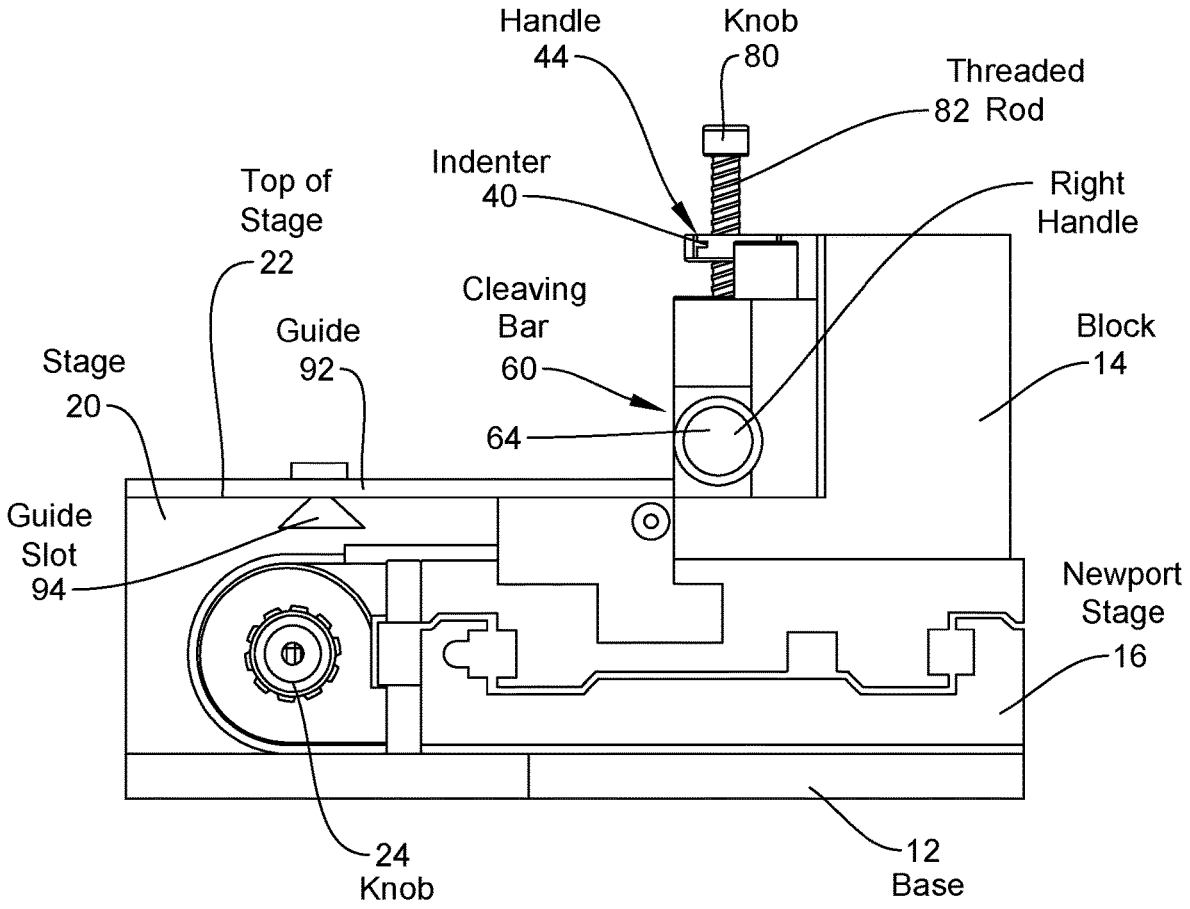
FIG. 2 is a side view of a first example of a device for cleaving a substrate.
Figure 3:
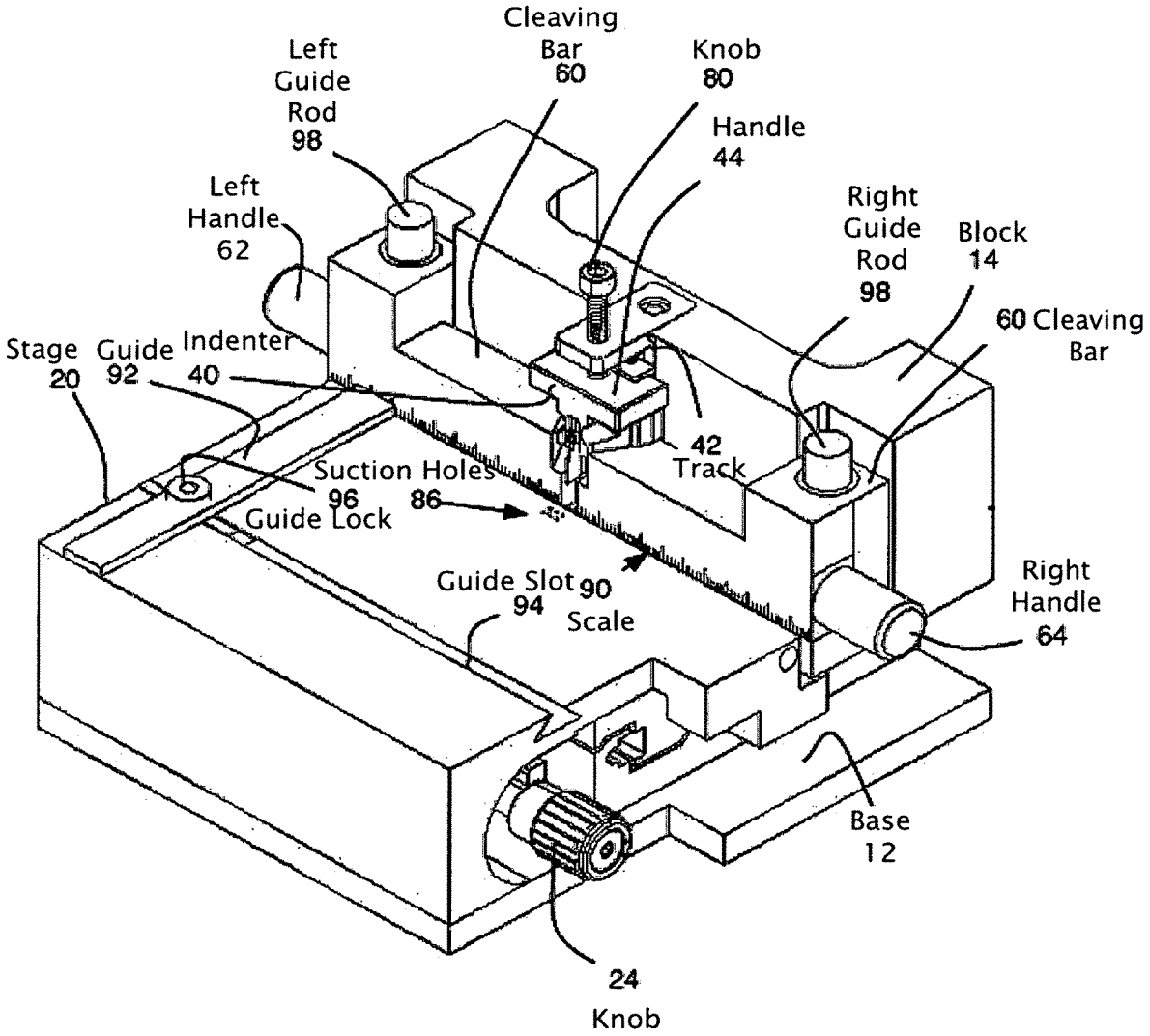
FIG. 3 is a front isometric view of a first example of a device for cleaving a substrate.

Returning to the block 14 that provides support for the abovementioned mechanisms, it is generally "L" shaped when viewed from the side as in FIG. 2, and is fixedly coupled to the moving top piece of the Newport Stage 16. An edge at the bottom of the "L" closely abuts the table top 22, and adjusting the Newport stage via knob 24 and the associated micrometer mechanism 2602 causes the block 14 to move typically slowly in the x direction 1008 back and forth along edge of the fixed tabletop 12. Clockwise and counterclockwise rotation of the knob 24 causes movement to the right or left in the x direction 1008 of the block 14. The Micrometer mechanism 2602 may be equipped with a right hand screw, or equivalently a left hand screw. In equivalent examples the knob 24 may protrude from the left hand of the device.

The bottom of the "L" of the block 14 may include two vertical (in the z direction 1008) guide rods 98 over which the cleaving bar 60 with matching apertures may be slidably disposed. The upper surface of the bottom of the "L" is dimensioned such that it is generally the same height as the top of the stage 22, so that when the cleaving bar 60 is resting against the upper surface of the bottom of the "L" the bottom of the cleaving bar 60 is approximately in the same x-y plane as the stage top 22.

A breaking pin (50 of FIG. 1, and FIG. 25) is disposed under the cleaving bar 60. The pin 50 is centered to align with the vertical axis of the diamond tip 48 that creates the indentation on the sample (2502 of FIG. 25). The diamond tip 48 indents the top surface of the sample 1005, but the breaking pin 50 is arranged to contact the bottom surface of the sample when it is pushed further in along the guide 92. The breaking pin 50 is positioned in line with the diamond tip 48 in the y direction 1008, and behind it so that after the sample is indented by the indenter 40, it may be pushed further back under the cleaving bar 60 so that the cleaving line 1002 defined by the indent on the work piece 1005 is centered side to side in the x direction 1008 over the breaking pin. The cleaving bar includes on its underside two breaking pins (2501 FIG. 25) so that as force is applied on either side of the breaker pin 50 as the cleaving bar 60 breaker pins are pressed down against the work piece 1005 cleaving at the indent, and thus the cleave line is achieved.

Upright portion of the "L" shaped block 14 may be unitary with the bottom of the "L", or equivalently be a separate pieces attached together. Block 14 provides support and a channel for slidably coupling the indenter mechanism 40 in the vertical or, z direction 1008. To keep the indenter 40 retracted upward until needed spring bias is provided by conventional methods to push the indenter mechanism upwards. Upward travel of the indenter is limited by a screw 80 threadabaly engaged in an aperture protruding from the block 14. The indenter mechanism 40 may be pushed downward or up by utilizing the screw 80, or equivalently the handle 44 of the indenter 40 may be pressed down to create an indent in a sample.

Figure 5:
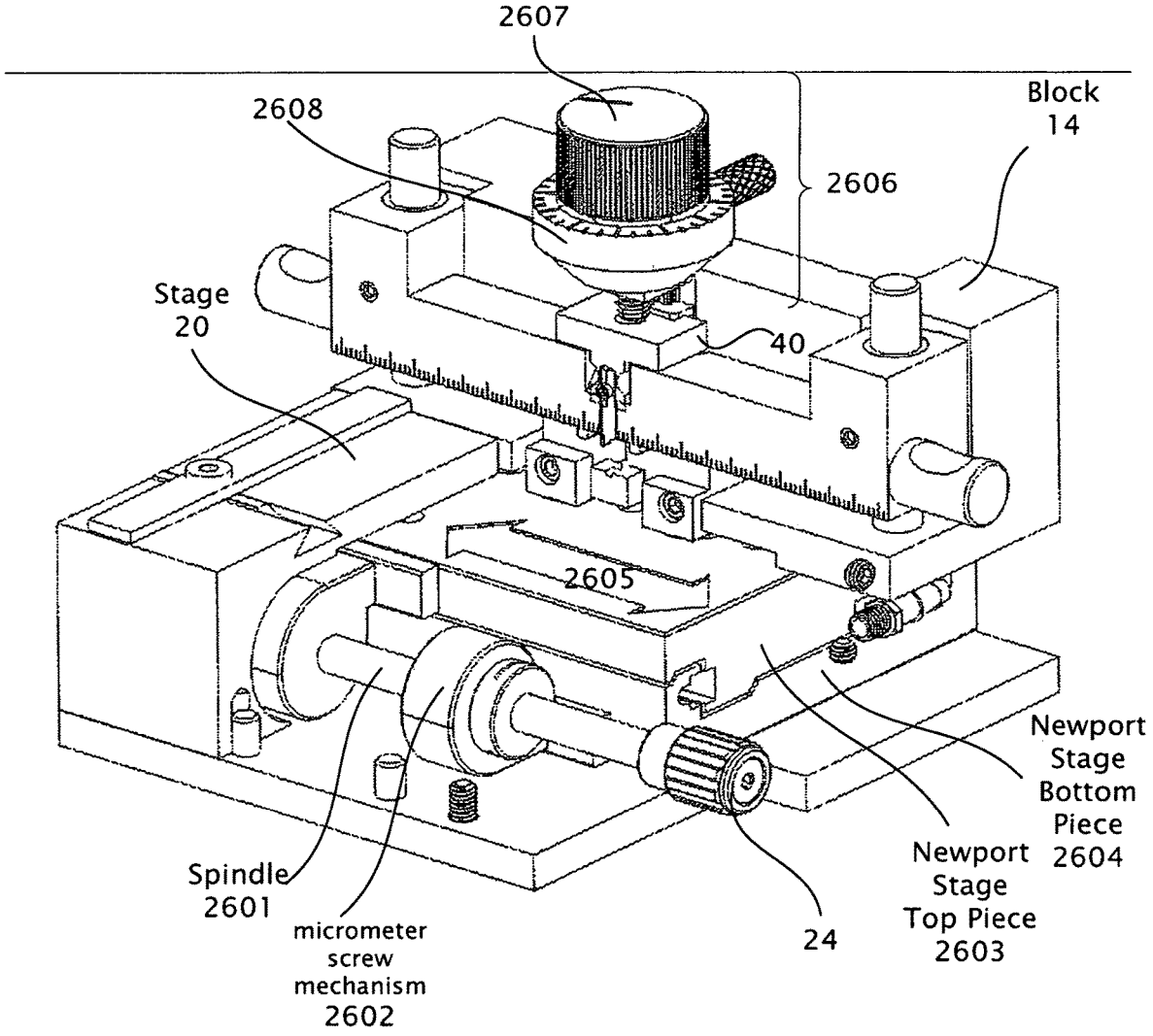
FIG. 5 is a partial cutaway of the stage showing a first example of a device for cleaving a substrate showing the exemplary Newport stage and an indenter with a compound dial.

FIG. 5 is a cutaway view showing further detail of the exemplary Newport stage, and further including a more precise knob adjustment mechanism 2606 to control the indenter. Here the recess under the stage may be seen, as the stage has been partially cut away. The knob 2606 is conventionally constructed so that the inner 2607 and outer 2608 knobs turn independently. In operation the center knob is turned to position the diamond tip scribe just above the sample. Next the outer knob is turned a desired amount to further advance the diamond tip scribe into the sample to a given depth. The outer knob may include a scale to aid in repeatability.

Figure 6:
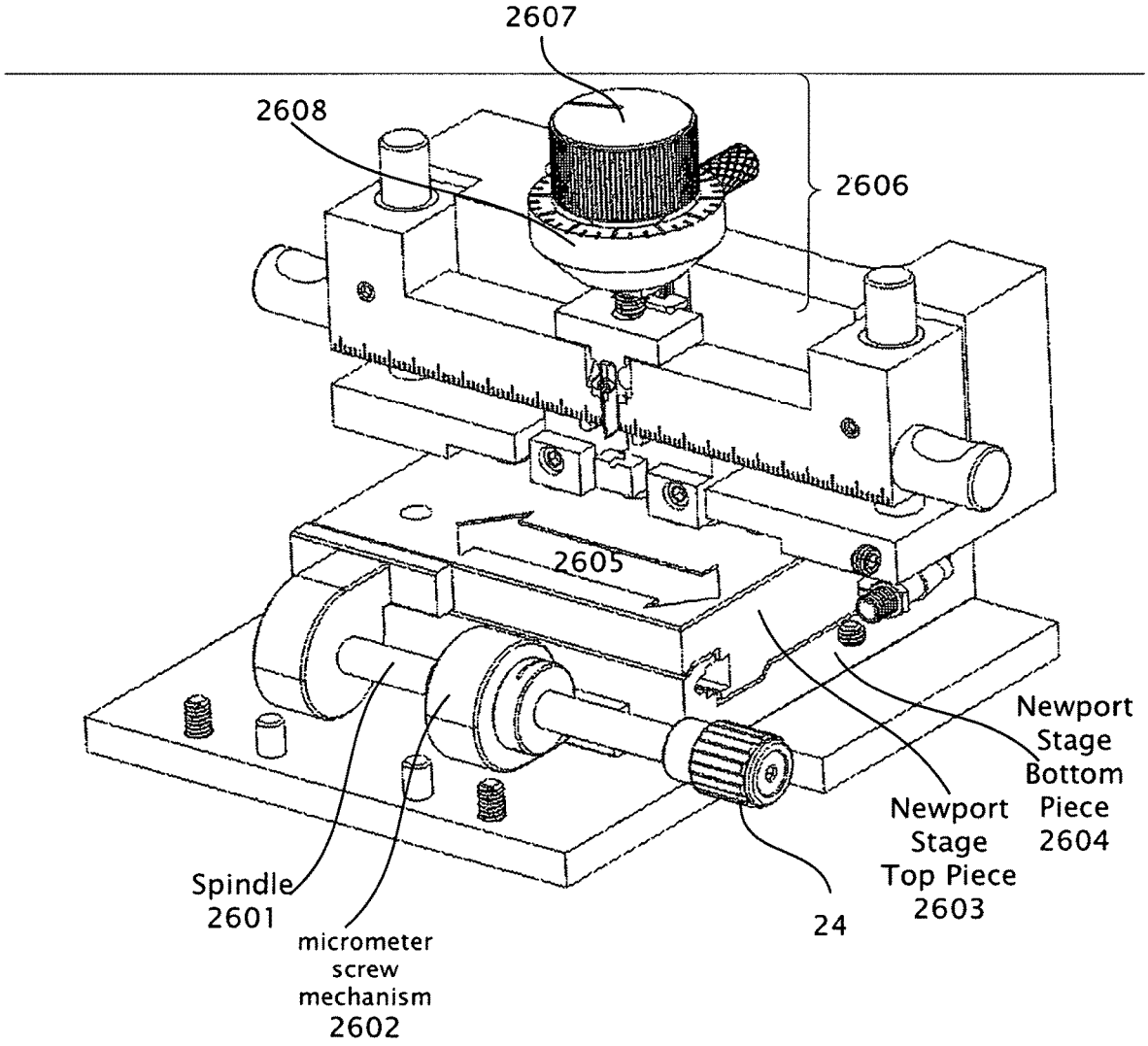
FIG. 6 is a full cutaway of the stage showing a first example of a device for cleaving a substrate showing the exemplary Newport stage and an indenter with a compound dial.
Figure 7:
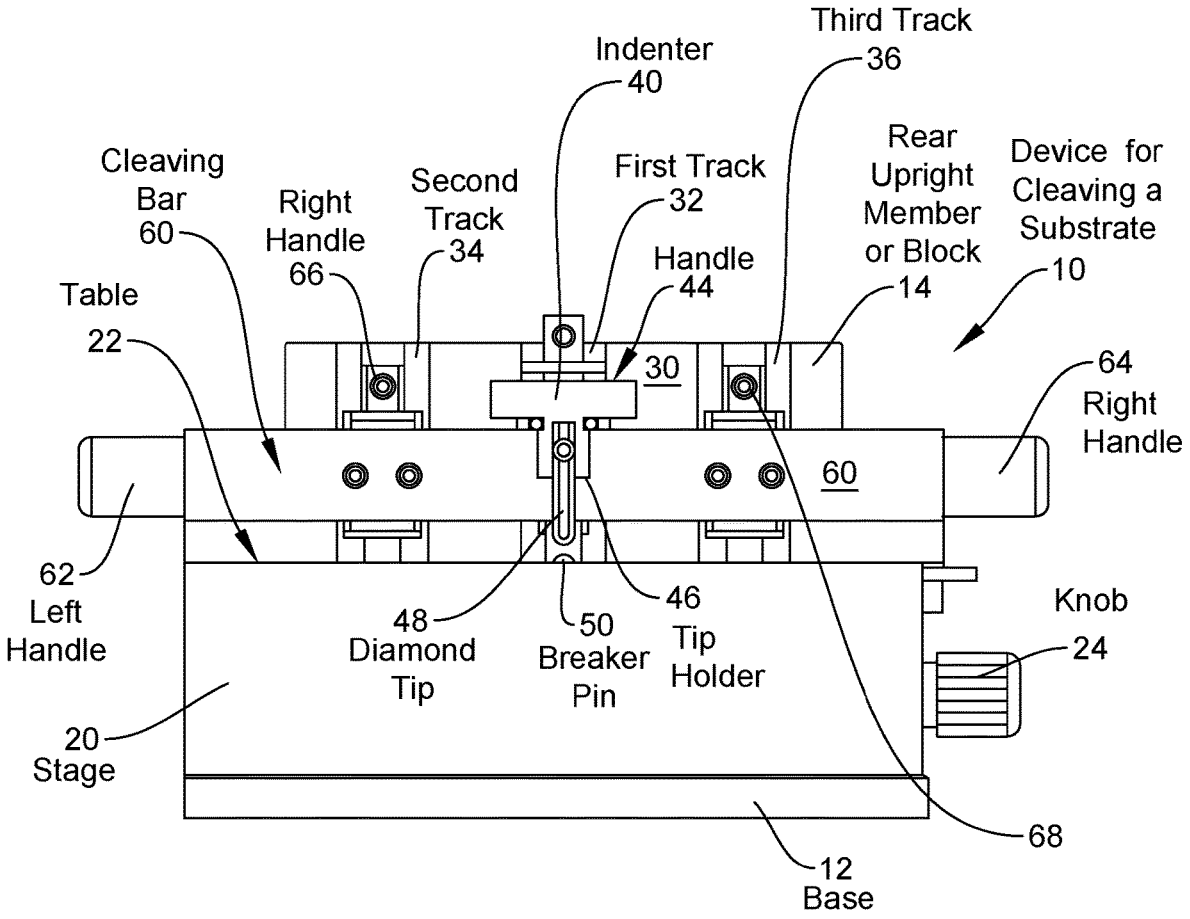
FIG. 7 is a front view of a second example of a device for cleaving a substrate.
Figure 8:
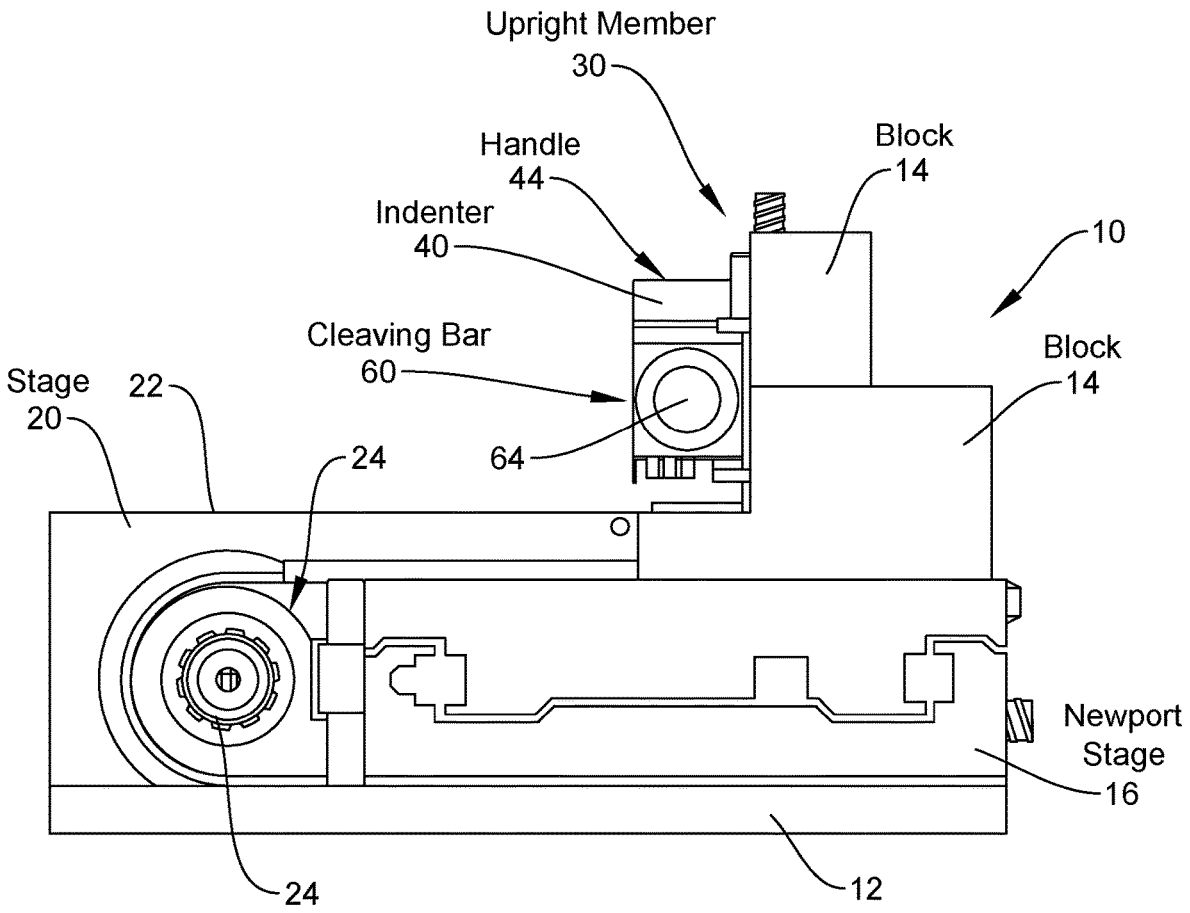
FIG. 8 is a right side view of a second example of a device for cleaving a substrate.
Figure 9:
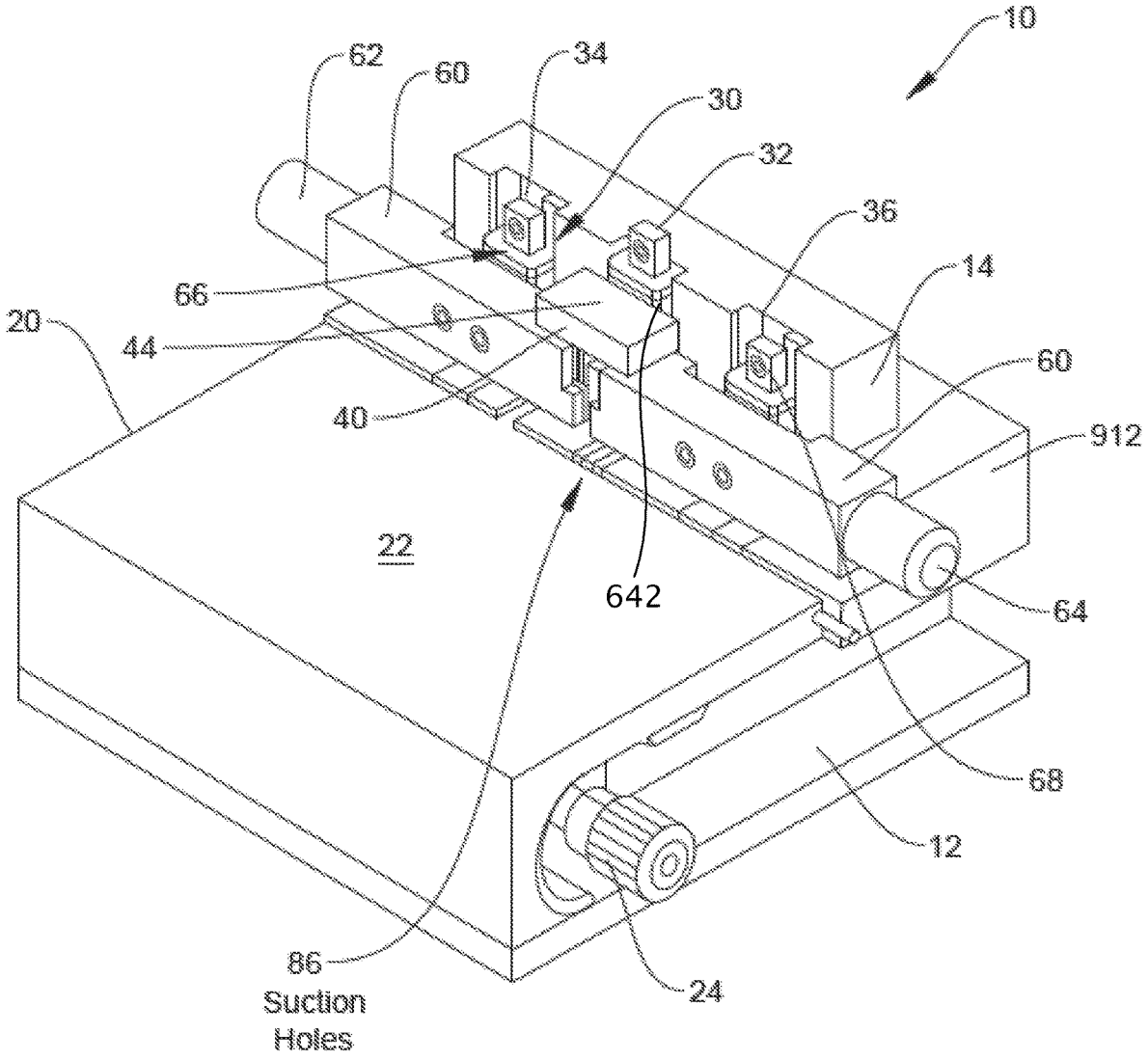
FIG. 9 is an isometric frontal view of a second example of a device for cleaving a substrate.
Figure 10:
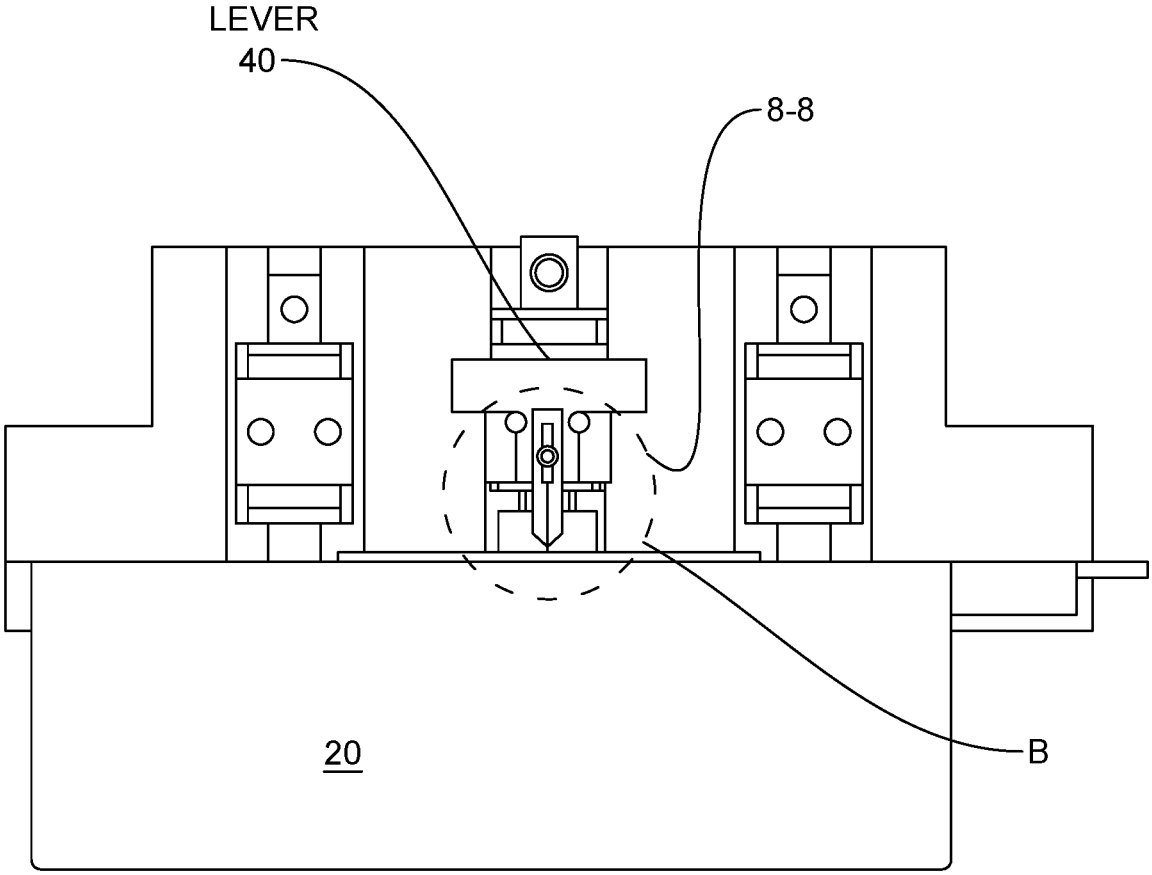
FIG. 10 is a partial front view of a second example of a device for cleaving a substrate.
Figure 11:
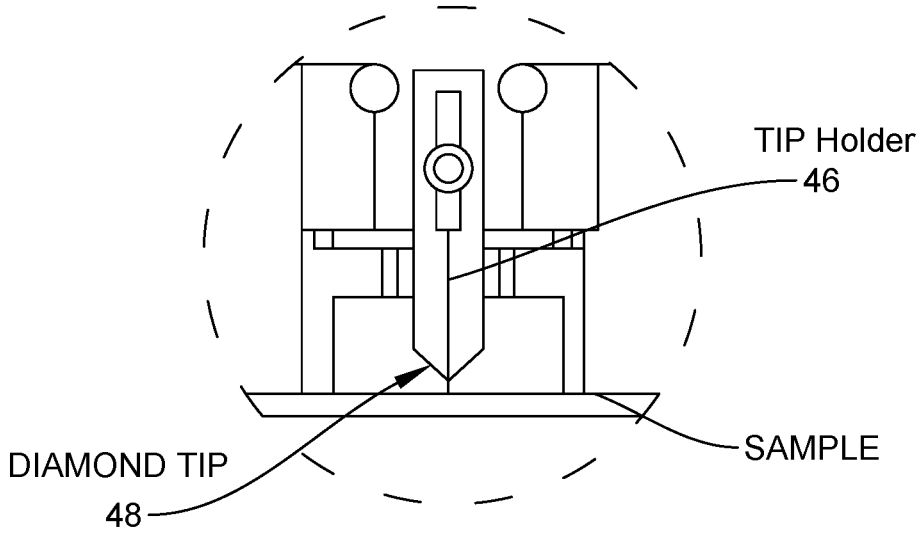
FIG. 11 is a detail view of the second example of a device for cleaving a substrate of FIG. 10 along the line 8-8.
Figure 12:
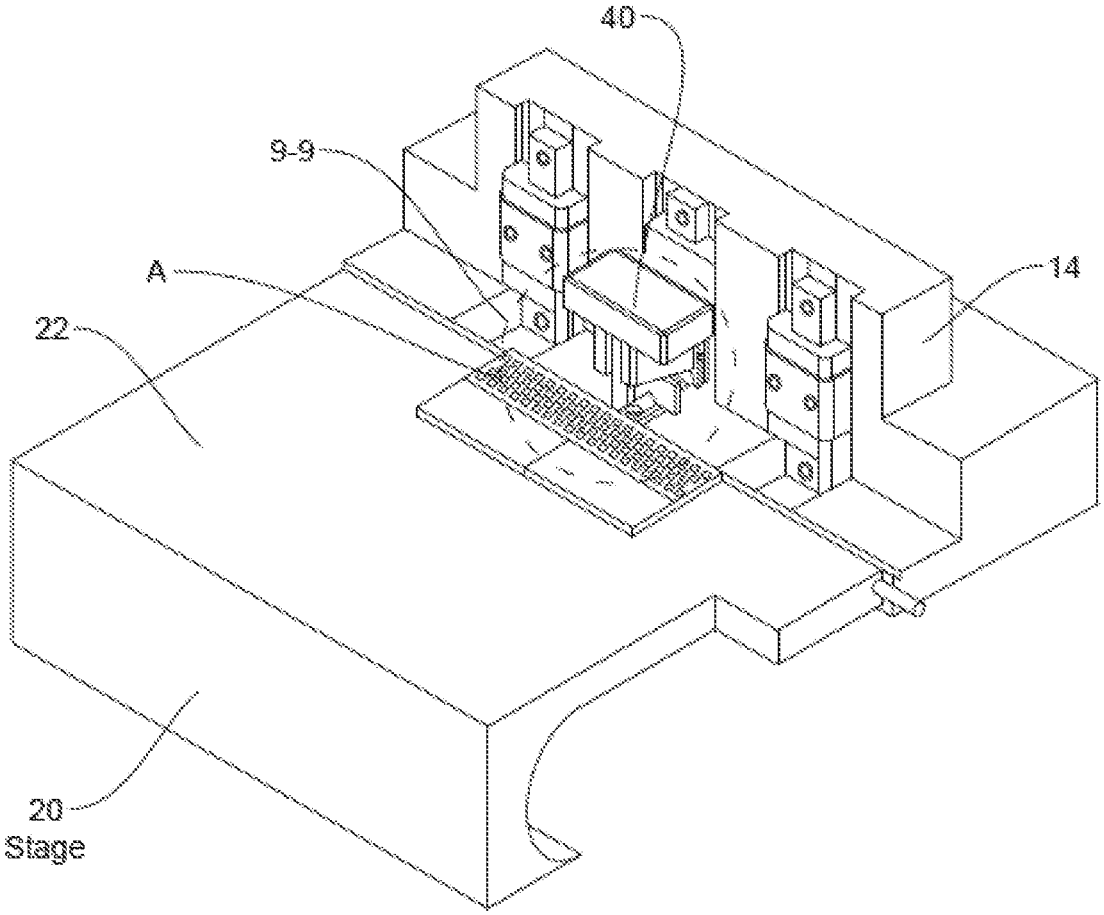
FIG. 12 is a frontal view of the of a second example of a device for cleaving a substrate.
Figure 13:
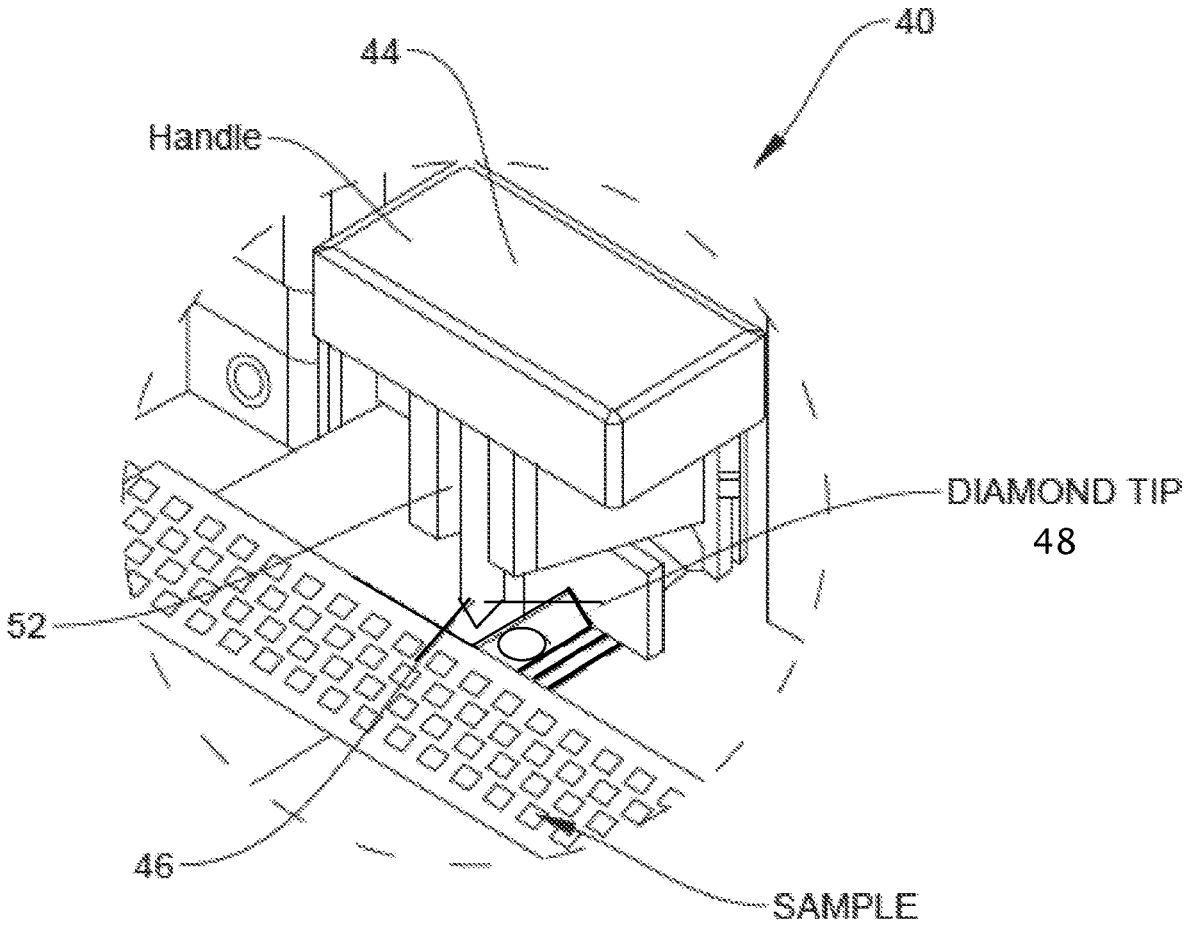
FIG. 13 is a detail view of the of a second example of a device for cleaving a substrate of FIG. 12 along the line 9-9.
Figure 14:
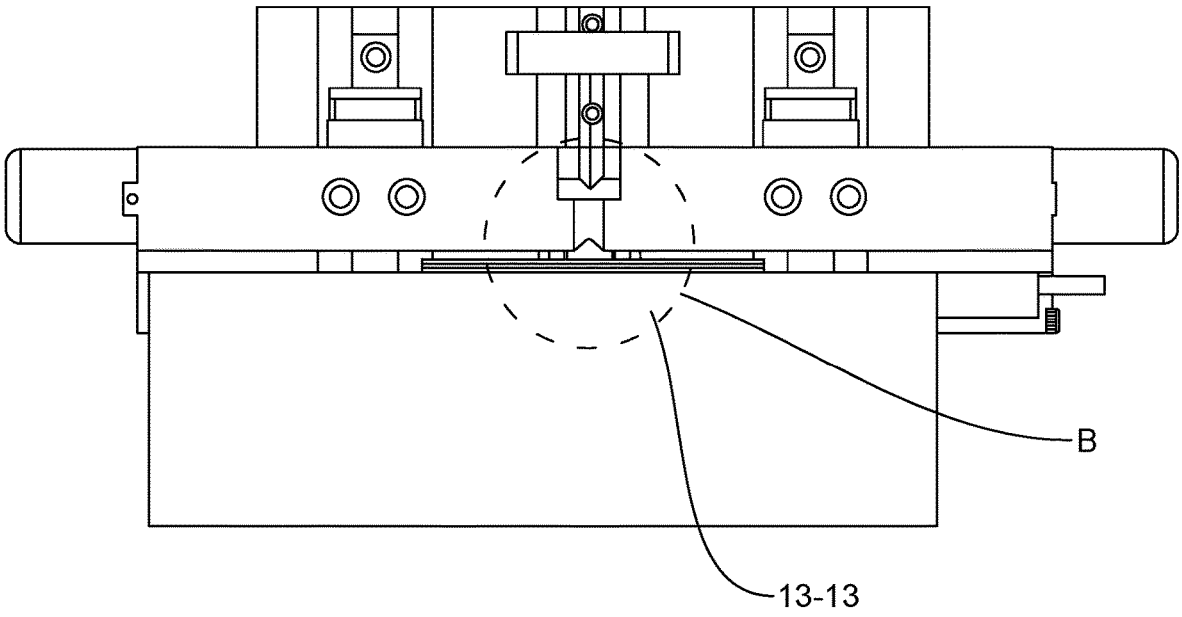
FIG. 14 is a partial front view of the second example of a device for cleaving a substrate.

FIG. 6 is a fully cutaway view (with the fixed stage completely removed) showing the exemplary Newport stage that is incorporated into the first example of the invention, and showing the micrometer coupling of the top and bottom portions of the Newport stage.

FIGS. 5 and 6 are cut away views that show the exemplary Newport stage 16 and adjustment mechanism. The stage includes a top piece 2603, and a bottom piece 2604, conventionally coupled by a conventionally constructed ball bearing race to allow linear movement—here oriented in the x direction. The stage is coupled to the knob 24 via a micrometer screw mechanism 2606. The block assembly 14 shown with an indenter mechanism 40 moves in the X direction 2605 while the stage 20 holding the sample does not move. Since the entire top of the Newport stage is not needed, and to make the device 10 more compact, part of the Newport stage extends under the stage 20, which has a cavity underneath to accommodate a portion of the Newport stage and the adjustment mechanism 2602, 2601. The height of the cavity under the stage 20, is sufficiently high so that the top portion of the Newport stage (including the block and the components attached to it) can move 2605 freely back and forth.

Typically the adjustment in the X direction is controlled by a micrometer screw mechanism 2602 coupled to a Newport stage bottom piece 2604 which is slidably coupled to a movable Newport stage top piece 2603. The micrometer mechanism 2602 is coupled to the bottom piece 2604, and the spindle 2601 is controlled by the micrometer mechanism 2602. The spindle 2601 is coupled to the Newport stage top piece 2603, whose movement is controlled by the micrometer screw mechanism 2602 to which it is coupled. The stage 2603 may be a commercially available High-Performance Low-Profile Ball Bearing Linear Stage such as the exemplary model 423 produced by the Newport corporation of Irvine Calif., a subsidiary of MKS Instruments or its equivalent.

The exemplary Newport stage may include a typically 3 inch square platform utilizing precision ball bearing construction—typically hardened balls rolling between opposing pairs of hardened and polished stainless steel rods providing better than 200 micro-radian angular deviation, for example. For stability, repeatability, and smooth motion, actuators may bear upon a hardened carbide insert. Springs may provide preloading against the actuator tip to eliminate backlash. Although the stage is typically capable of traveling a full 1 inch (25.4 mm) with an SM-25 micrometer drive, the actuator mounting blocks can be relocated to accommodate 0.5 inch (12.7 mm) drives like the SM-13. This stage can also be reconfigured into a left-handed version with the micrometer on the opposite side. A non-influencing lock (also reversible for left-handed configuration) provides positive stable positioning and guards against inadvertent adjustments.

FIGS. 7-19 show a second example of a device for cleaving substrates. In a second example the adjusting knob (80 of FIG. 1) of the first example is omitted. Accordingly, the device 10 also includes a stage 20 disposed on the housing body 12, the stage having a substantially flat top 22 and a mechanism for adjusting horizontally in the x-direction with sub-micron precision, and a knob 24 rotatably coupled to the mechanism for adjusting the stage.

The device 10 includes a base (912 of FIG. 9) comprising a rear upright member 14 arranged on a lower frame 16 at about a right angle, the rear upright member including a first track 32, a second track 34, and a third track 36 wherein each track is substantially coplanar and extending vertically along a front face 30 of the rear upright member.

The device 10 further includes a lever comprising 40 a slide member 642 (of FIG. 9) slideably inserted in the first track 32, the lever further including a handle 44 and a retraction spring, which is adapted to hold the slide at a top position in the first track and the handle member is operable to move the lever vertically downward, the lever further carrying a diamond tip scribe 48 in a tip holder 46, the indenter having a diamond tip 48 at a lower, leading edge. Although a 90-degree dent is described here this "scribe" could be made at various angles between about 45-13 5 (+/−45) degrees. A derivative of the current example could be implemented with this angle adjustment to improve positioning accuracy and minimize the contact area between the sample and the diamond tip.

The breaker assembly 60 is disposed on the rear upright member 14. The breaker assembly is one solid bar having a left side 62 slideably inserted in the second track 34 and a right side 62 slideably inserted in the third track 36 and a center portion inserted in a center track. These three tracks cooperate to enable the bar 60 to move only in the up and down direction.

Figure 19:
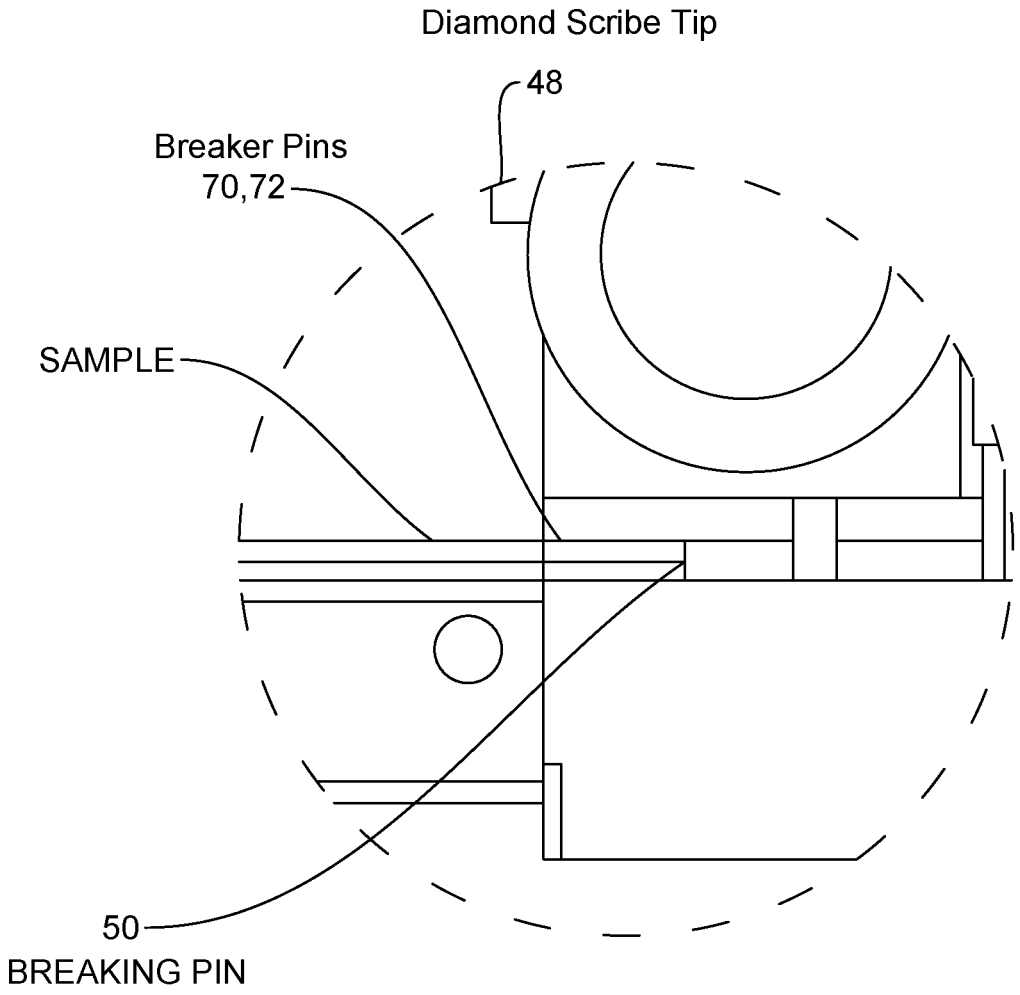
FIG. 19 is a detail view along the line "C" of FIG. 18.

As in the first example, the breaker 60 includes a left and right breaker pin 70 and 72 (also see 2501 in FIG. 25) on its bottom surface, and these pins operate as described in the first example. The breaker pins 50, 70, 71 position behind the scribe tip 48 as seen from the side is shown in FIG. 19. The arrangement of the breaker pins behind the scribe tip is the same in both the first and second examples of the cleaving device 10.

It will be appreciated by those skilled in the art that any of the sub-components of the first and second examples can be combined with each other and still lie within the scope and spirit of the contemplated invention.

FIG. 20 shows a third example 200 of a device for cleaving substrates including a camera system. The camera includes a vertical mounting pole arranged perpendicular to table. Also an optical microscope may be included with the device to improve target and positioning accuracy. An optional vacuum or CDA may be included to create a vacuum, which will improve the cleanliness and accuracy of the cleave. For example, compressed air is used to hold the sample on the table, but also can be used to remove dust from the table by manually using a nozzle to dust off the table. In addition, suction devices, such as a vacuum pen, may be included for aiding in the removal of the cut sample from the table.

To provide magnification, the entire device, may be placed under an Optical Microscope with long working distance optics (FIG. 20). Another option is to use a compact digital camera or other magnifying optics with the device.

A camera system 210 is coupled to the device 10, of either the first or second examples. The camera system 200 includes a camera 210 mounted to a camera support 220 that allows for vertical positioning of the camera 210 and movement 360 degrees around this vertical axis and about 360 degrees rotation parallel to this axis so that the camera may be positioned to image the sample S on the stage 20 of the device.

The camera 210 is in data communication with a computer 230 by means of a cable 232 or wirelessly using standard protocols such as Bluetooth or WIFI, for example. The computer includes a software program that projects a virtual line over the image of the sample on the screen. This line corresponds to the axis of the diamond indenter 50 of the device 10 to better enable precision cleaving of the sample S.

The camera system of the third example would work equally well in conjunction with the first and/or second examples. For brevity, the camera system 200 is described with reference to the second example, however those skilled in the art will appreciate its applicability to any of the examples and the camera system can be readily modified and adapted for use with any of the examples without undue experimentation.

The computer 230 can be any Mac, PC, or Unix-based system, laptop, desktop or equivalent, as would be well-appreciated by those of ordinary skill in the art.

A base of the camera stand 220 may be coupled to the base (12 of FIG. 1) for the device 10 for stability. In equivalent examples the base is not coupled to the device 10.

A stage with X-Y motion (not shown) can be coupled to the base (12 of FIG. 1) which can then be coupled to the base of the camera support 220. X-Y motion enables viewing of a larger area of the sample prior to selecting the cleaving direction.

Figure 21:
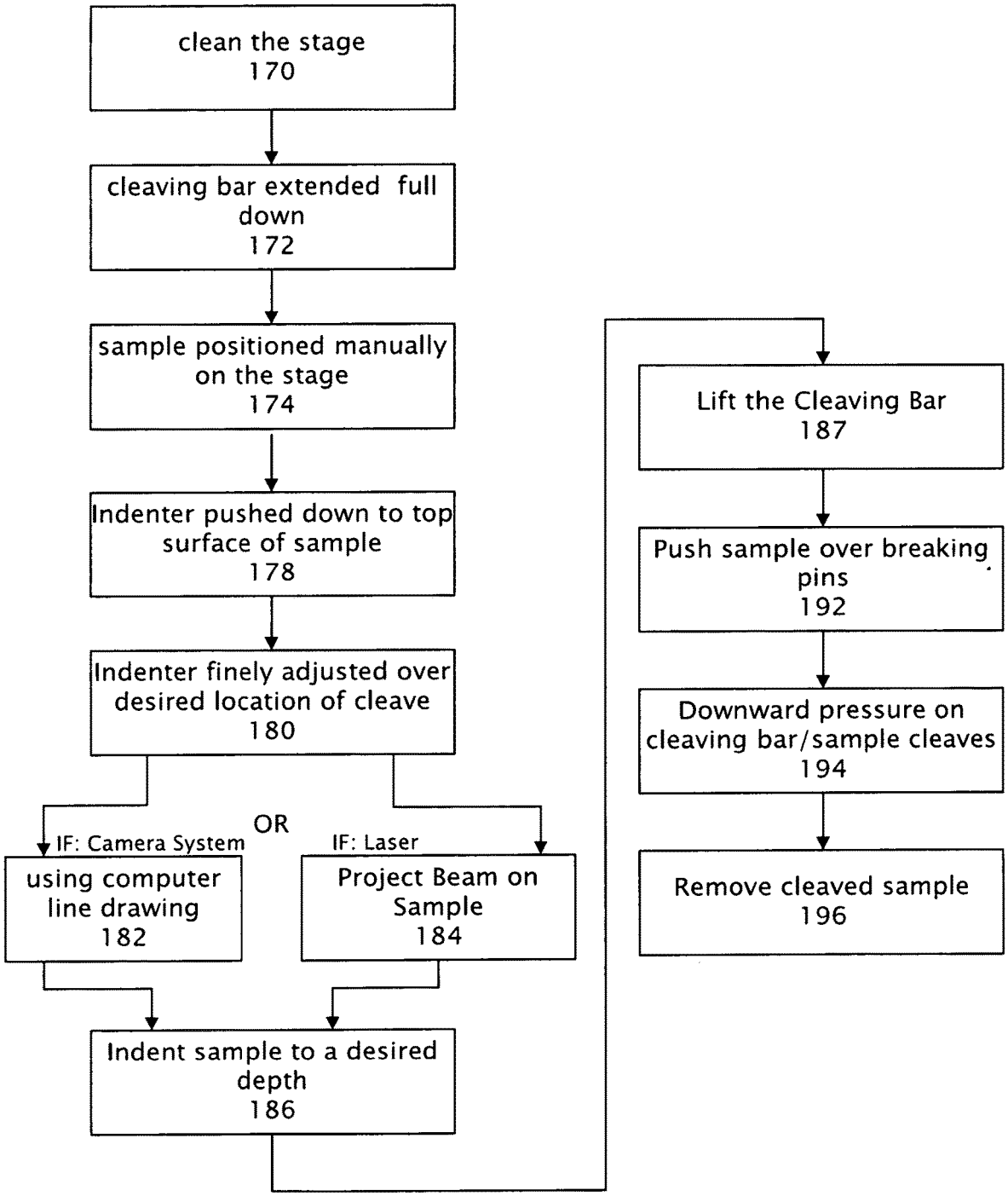
FIG. 21 is a flow chart of a method for cleaving a substrate.

FIG. 21 is a flow diagram showing a method of cleaving a substrate using the devices for cleaving a substrate described above. The method of cleaving a substrate may be accomplished using any of the three previously described examples. For brevity, a method of use is described herein with reference to one of the examples and those skilled in the art will understand that additional steps could be augmented without detracting from the scope of the invention. Conversely, and equally applicable, elements could be eliminated or combined and still not detract from the scope and spirit of the invention.

A first step is to clean the stage (block 170), especially under the cleaving bar as dust and other debris on the stage can damage the cleave, result in an inaccurate cleave, damage the mechanism, or otherwise waste or make inefficient the process of cleaving a substrate. One possible way to clean the stage is with a fine bristle brush, another way is to blow compressed air across the surface, or clean by equivalent techniques.

The cleaving bar is extended to its full down position and the sample is positioned on the stage with its front edge flush against the cleaving bar (block 172). This helps roughly positions the sample on the stage.

Next the sample is placed on the stage (block 172) and positioned manually in front to the indenter, and the scribe guide is set.

Manual (or coarse) positioning of the sample is adjusted by putting the area of interest ("AOI") of the square or rectangular sample, and the knife-edge in approximate alignment. The substrate (1005 of FIG. 4) is approximately positioned on the stage with a desired cleave line (1002 of FIG. 4) visually lined up with the diamond tip (48 of FIG. 1).

The diamond tip has previously been positioned somewhere along the edge of the stage, for example to accommodate the size of the sample. If the work piece has an edge perpendicular to the edge that has been aligned against the cleaving bar then the work piece may also be held secure by the scribe guide (92 of FIG. 4) with the guide adjuster (96 of FIG. 4) secured. The cleave line is now approximately positioned in line with the diamond tip.

Next, for systems that do not include a camera system, the spring-loaded indenter (40 of FIG. 1) is pushed down by hand until the diamond tip of the indenter is just above the top surface of the sample, but not touching the surface (block 178).

The diamond tip can now be moved to fine position it over the desired cleave line of the stationary sample on the stage. Turning the knob 24 moves the diamond tip over the desired location of the cleave (block 180) on the sample. The sample had been positioned on the stage previously, so that excessive movement of the knob is not necessary to position the tip over the cleave line to achieve a more accurate cleave For systems that include a camera system, a more precise alignment of the cleave can be positioned by using a line drawing feature of the software associated with the camera system (as described above) (block 182). The line drawing feature superimposes a visual line on a monitor with a live image of the sample on the stage in focus. Again, the stage drive knob provides precise x-direction alignment of the virtual line relative to the sample.

In another example, a laser beam can be projected on the sample (block 184) corresponding to the location of the indenter apex. This laser beam system may be incorporated into with the camera system. An advantage of the laser is that the camera is not required to visualize where the cleave would lie on the sample. However, also using the camera allows magnification of the sample and therefore allow a more precise visual and manual aligning of the sample relative to the indenter.

With the indenter positioned accurately over the sample, next continued pressure on the indenter results in the indenter pushing into the sample (block 186). If the device includes an indenter drive knob, this knob can be turned until the indenter is touching the top of the sample and the sample is now pinched between the indenter and the breaker, or cleaving bar. Next an indent to a desired depth is made by turning an indenter knob a desired amount.

Then, a twist of the knob clockwise corresponding to the needed movement for downward travel creates sufficient pressure on the sample to enable smooth operation of the indent. If this indenter drive knob 80 is not included in the system, then the operator uses hand pressure on the indenter bar while manipulating the scribe.

Next, the breaker, or cleaving bar is lifted (block 187), and the sample is re-positioned for cleaving. With the cleaving bar lifted, the sample is slid under the cleaving bar until it is over the breaking pins (block 192). The indentation line that is physically on the sample as a result of the scribe line just described is visually aligned to a reference mark on the back wall. The scribe is positioned on the breaker pin hill. For systems with a camera system, accuracy can be verified by viewing the monitor.

Next, the cleaving bar is pushed down against the sample. Downward pressure on the knobs causes the sample to break at the scribe line (block 194). Next, lift up the cleaving bar and remove the cleaved sample from the stage (block 196).

The device 10 of the present invention, in all of its various examples, is well suited for cleaving substrates of most known diameters from about ¼ inches to about 12 inch diameters, but this should not be limiting. However, other sized substrates would work equally well with little or no modification to the components of this invention.

FIGS. 21-25 illustrate the process of cleaving a sample that is carried out by the examples of the device 10. The process includes creating an indentation on a top surface of the sample by applying a downward force along a vertical axis. The vertical axis is perpendicular to the top surface of the sample, and the downward force can align with the vertical axis or be offset +/−45 degrees. Further, the process includes providing a breaking pin and arranging the breaking pin under the sample, coincident to a bottom surface of the sample at a position that is directly opposite from the indentation. The process also includes applying a downward force on the sample wherein the downward force comprises a left-side downward force and right-side downward force, each left-side and right-side downward force arranged on opposite sides of the indentation on the top surface.

Figure 22:
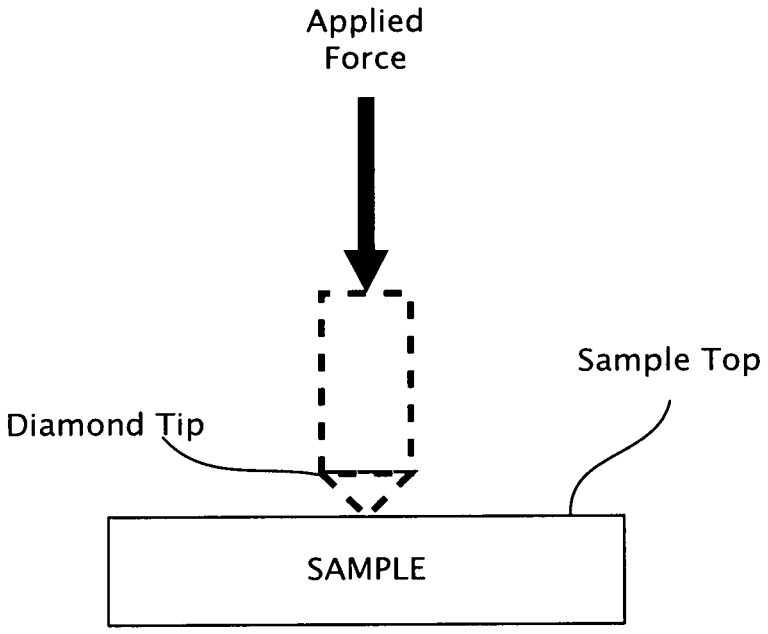
FIG. 22 illustrates one step of a method for cleaving a substrate.
Figure 23:
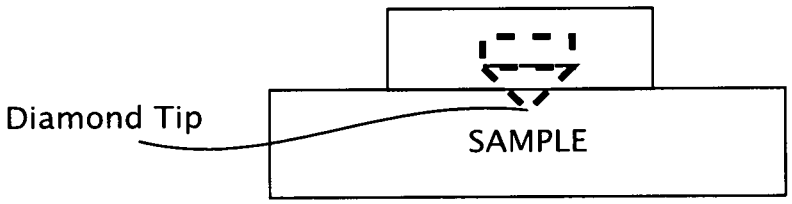
FIG. 23 illustrates an alternative step of the method of FIG. 22.
Figure 26:
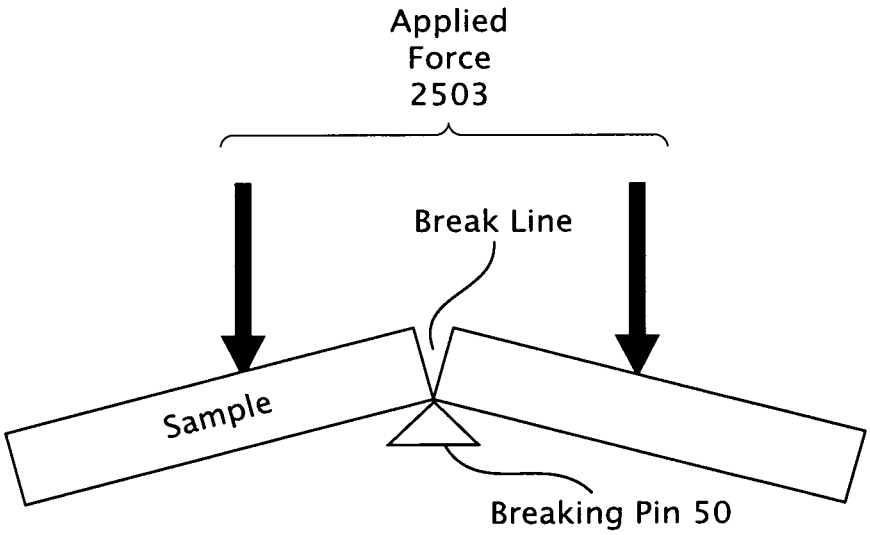
FIG. 26 illustrates the sample of FIG. 25 at a second point in time.
Figure 27:
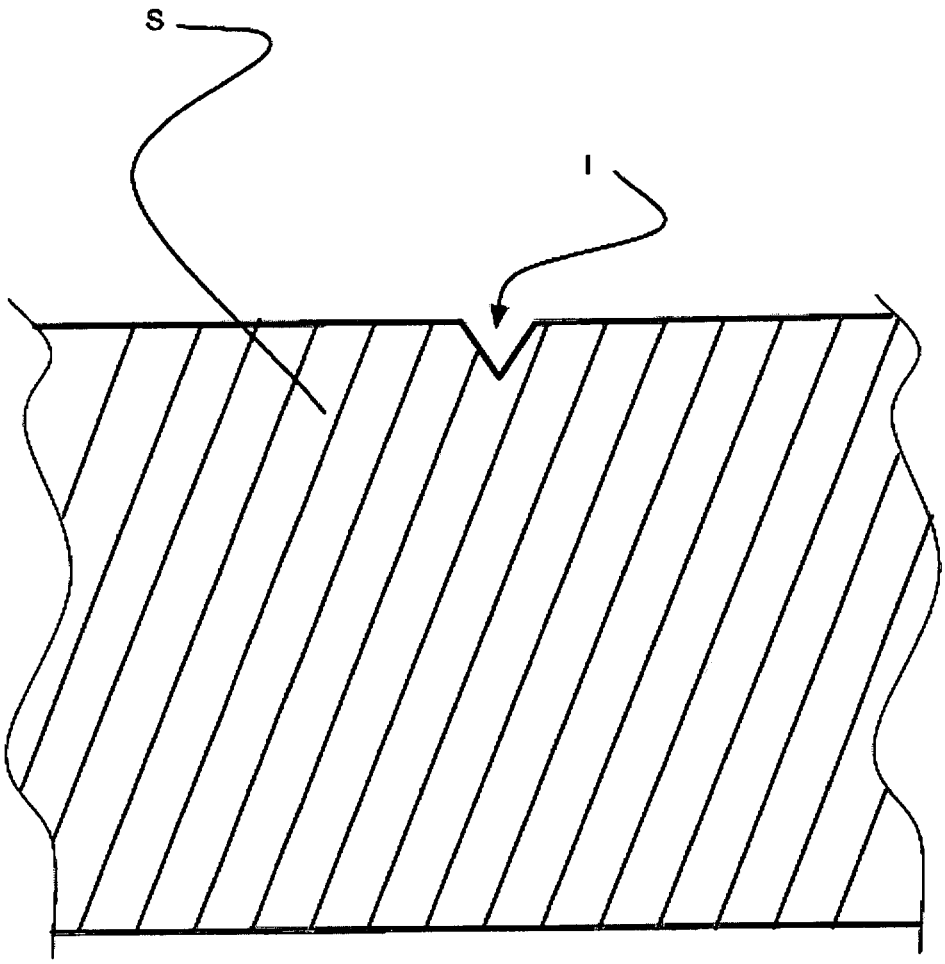
FIG. 27 is a cross sectional view of a portion of a sample S having an Indentation I according to at least one example of the present invention.

More specifically, FIGS. 22-24 depict indenting, and FIGS. 25-26 depict breaking (or cleaving). From FIGS. 22-26, it will be appreciated that the two steps work together to provide a complete and improved cleaving process. Accordingly, FIGS. 22-23 shows an indentation being created on the top surface of a sample. FIG. 24 illustrates that this indentation can be created at 90 degrees+/−45 degrees tilt from the vertical axis. Then, with the indentation complete from FIGS. 22-25, as appropriate, the cleaving (or breaking) process can begin. FIGS. 25-26 show a downward directed applied force pushing against the top surface of the sample. The downward force is split to the left and right sides of the indentation. And, an opposite resisting force is applied by the breaking pin, which touches the bottom surface of the sample. As the downward force increases, and because of the indentation on the top surface, the sample yields at the indentation and a clean break or cleave is obtained. It will be appreciated from these figures that the indentation and bottom breaking pin are aligned in a common vertical axis.

Further, this process contemplates providing a knife or indenter having a diamond tip and enabling the indenter to adjust up to +/−45 degrees from perpendicular, arranging the indenter on the vertical axis and enabling the indenter to be operable from a first retracted position to a second extended position wherein the extended position causes the indenter to contact the top surface of the sample.

Another contemplated process includes either cleaving or indenting or both on one machine or on two separate machines.

Another contemplated process includes a first machine for indenting a sample and a second machine for cleaving the sample. The operations of cleaving and indenting can then be done independently and one operation would not need the other operation. For example, a machine could indent a sample, but the cleaving of that sample could be done by hand, or by another traditional cleaving device known in the art.

Another contemplated process holds the top left and right pins stationary and makes the bottom breaking pin move upward towards the left and right pins. One example is that the entire stage could be operable to move from a retracted, down position to a second upward position that causes the indenter and/or left and right pins to contact the sample, and to continue moving to either indent the sample or to cleave the sample, or both. The relative movement of the breaking pin in relation to the left and right pins, which are positioned on either side of the indentation is desired. However, how the indentation was made, or which pins move, and which direction the pins move, is not as important as the relative motion between these elements.

Another contemplated process includes the steps of providing a cleaving device comprising a stage horizontally disposed on a housing body, the stage having a substantially flat top and a means for adjusting horizontally in the x-direction with micron precision; an indenter slideably arranged to be operable along a vertical axis arranged perpendicular to the top of the stage, the indenter slideably mounted to the housing body, the indenter comprising an indenter comprising a diamond tip, the indenter disposed to operate from a first retracted position to a second extended position along the vertical plane; a breaking pin mounted on the housing body under the indenter; and a breaker, or cleaving bar disposed on the housing body and being operable along a vertical axis from a first retracted position to a second contacting position, the breaker, or cleaving bar further including a left side breaker pin arranged on a bottom surface of the breaker, or cleaving bar and a right side breaker pin on the bottom surface wherein the left and right side pins are disposed on opposite sides of the breaker bar relative to the vertical axis; placing the sample on the stage; creating an indentation on a top surface of the sample by applying a downward force along a vertical axis, the axis perpendicular to the top surface of the sample; applying a downward force on the sample wherein the downward force includes a left-side downward force and right-side downward force, each left-side and right-side downward force applied on opposite sides of the indentation on the top surface.

This process also includes pushing on the left and right breaker handles simultaneously causing the breaker assembly to move downward, causing the left and right breaker pins to press against the sample; contacting the sample on an underside by the breaking pin; and breaking the sample along the indentation by means of the breaking pin and left and right breaker pins.

This process further includes providing a camera system comprising a camera and software resident on a computer, the computer is in signal communication with camera the software adapted to display on the computer an image; and using the camera system to align the sample.

FIG. 25 is a cross sectional view of a portion of a sample S having an Indentation I. The indentation is generally "V" shaped, matching that of the scribe 48 that made the indentation.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A device for cleaving a sample comprising:

A first stage horizontally disposed on a base, the first stage having a substantially flat top for positioning a sample;

a second Newport stage disposed on the base and having a top portion operable by a micrometer adjustment mechanism;

a block coupled to the top portion;

an indenter coupled to the block and movable along an edge of the second Newport stage by operation of the micrometer adjustment mechanism, in which a lower upward facing breaking pin is disposed behind the indenter; and a vertically operable cleaving bar slidabaly coupled to the block and including two downward facing breaker pins oriented behind the indenter, whereby when the vertically operable cleaving bar is lowered the upward facing breaker pin is positioned between the two downward facing breaker pins.

2. The device for cleaving a sample of claim 1 further comprising:

a guide slot disposed in a top of the stage;

a guide slidabally coupled to the guide slot; and a guide lock thredabaly coupled to the guide.

3. The device for cleaving a sample of claim 2 in which the vertically operable cleaving bar is operable along a vertical axis from a first retracted position to a second contacting position, the cleaving bar two downward facing breaker pins include a left side breaker pin arranged on a bottom surface of the cleaving bar and a right side breaker pin on the bottom surface wherein the left and right side pins are disposed on opposite sides of the cleaving bar relative to the vertical axis.

4. The device for cleaving a sample of claim 1 in which the indenter is slidabaly disposed in a vertical channel in the block.

5. The device for cleaving a sample of claim 1 in which the indenter includes a tip holder and a diamond tipped scribe.

6. The device for cleaving a sample of claim 1 in which the indenter is pushed upward by a bias spring.

7. The device for cleaving a sample of claim 6 in which upward travel of the indenter is limited by a threaded rod.

8. The device for cleaving a sample of claim 7 in which the threaded rod includes a compound dial having an inner adjustment dial and an outer dial operable to advance the threaded rod through a threaded protrusion on the block.

9. The device for cleaving a sample of claim 1 in which the cleaving bar includes a scale.

10. The device for cleaving a sample of claim 1 in which the indenter includes a diamond tipped scribe.

11. The device for cleaving a sample of claim 10 in which the diamond tip protrudes over an edge of the stage.

12. The device for cleaving a sample of claim 1 in which the indenter is slideably arranged to be operable along a vertical axis arranged perpendicular to the top of the stage, the indenter slideably mounted to the housing body, the indenter comprising a diamond tip, the indenter disposed to operate from a first retracted position to a second extended position along the vertical plane.

13. The device for cleaving a sample of claim 1 further comprising:

a camera;

a computer;

software resident on a computer, the computer in signal communication with the camera the software adapted to display on the computer an image.

14. The device for cleaving a sample of claim 1 in which the indenter further comprises a knob coupled a threaded member, a scribe tip located at a distal end of the threaded member whereby rotation in a first direction of the knob causes downward movement of the indenter and rotation of the knob in an opposite direction causes retraction of the indenter.

15. The device for cleaving a sample of claim 1 further comprising an indenter tip that is selectively adjustable +/−45 degrees from a vertical axis.

16. A device for cleaving a sample comprising:

a stage horizontally disposed on a base, the stage having a substantially flat top;

an indenter slideably arranged to be operable along a vertical axis arranged perpendicular to the top of the stage, the indenter slideably mounted to the base, the indenter comprising a knife comprising a diamond tip, the indenter disposed to operate from a first retracted position to a second extended position along the vertical plane;

wherein the indenter further comprises a knob coupled a threaded member, the knife located at a distal end of the threaded member whereby rotation in a first direction of the knob causes downward movement of the knife and rotation of the knob in an opposite direction causes retraction of the knife; and wherein the indenter further comprises a knob configured for adjusting the indenter horizontally in the x-direction with sub-micron precision independent of the stage a breaking pin mounted on the housing body adapted to be positioned under the sample; and a cleaving bar disposed on the housing body and being operable along a vertical axis from a first retracted position to a second contacting position, the cleaving bar further comprising a left side breaker pin arranged on a bottom surface of the cleaving bar and a right side breaker pin on the bottom surface wherein the left and right side pins are disposed on opposite sides of the cleaving bar relative to the vertical axis.

17. A device for cleaving comprising:

a substantially flat base;

a first stage rectangular in shape, having a flat top including a straight edge, and parallel to the flat top a flat bottom that is attached to the base, and a recess disposed under the flat table top, the stage further including a guide slidabaly coupled to the first stage that includes a surface at right angles to the straight edge;

a second Newport stage having a top piece, and a bottom piece coupled to the base, with the top piece and the bottom piece mechanically coupled via a micrometer mechanism;

a block formed in an "L" shape and attached to the top piece of the second Newport stage the block including a flat portion of the "L" including a lower breaking pin, and an upright portion of the "L" including a vertical channel;

an indenter including a diamond tipped scribe slidabally coupled to the vertical channel, the indenter protruding over the straight edge and operable by the micrometer mechanism to move along the straight edge; and a cleaving bar slidabaly disposed on guide rods attached to the block, and having a bottom surface including a pair of breaking pins positioned in back of and equidistant from the diamond tipped scribe, and an edge with a scale parallel to the straight edge.

18. The device for cleaving of claim 17 further comprising:

a device for cleaving;

a camera support coupled to the device for cleaving and positioned to provide an image of a sample on a stage of the device for cleaving; and a computer coupled to the camera that displays an image of the sample.

19. The device for cleaving of claim 17 further comprising a microscope disposed between the camera and the device for cleaving.

* * * * *